US008127464B2

(12) United States Patent
Schöne

(10) Patent No.: US 8,127,464 B2
(45) Date of Patent: Mar. 6, 2012

(54) FRONT RING FOR A HOUSEHOLD APPLIANCE DOOR

(75) Inventor: Oliver Schöne, New Bern, NC (US)

(73) Assignee: BSH Home Appliances Corporation, Huntington Beach, CA (US)

( * ) Notice: Subject to any disclaimer, the term of this patent is extended or adjusted under 35 U.S.C. 154(b) by 323 days.

(21) Appl. No.: 12/533,034

(22) Filed: Jul. 31, 2009

(65) Prior Publication Data

US 2011/0023316 A1 Feb. 3, 2011

(51) Int. Cl.
*F26B 11/03* (2006.01)

(52) U.S. Cl. ..... 34/603; 34/610; 68/196; 68/212; 312/228

(58) Field of Classification Search ..... 34/88, 108, 34/105, 601, 603, 610, 242; 68/196, 212; 312/228

See application file for complete search history.

(56) References Cited

U.S. PATENT DOCUMENTS

| | | | | |
|---|---|---|---|---|
| 2,165,884 | A * | 7/1939 | Chamberlin et al. | 8/159 |
| 3,089,327 | A * | 5/1963 | Stilwell, Jr. | 68/139 |
| 3,273,256 | A * | 9/1966 | Behrens | 34/546 |
| 3,436,934 | A * | 4/1969 | Stilwell, Jr. | 68/140 |
| 6,761,049 | B2 | 7/2004 | Nitschmann et al. | |
| 7,299,666 | B2 | 11/2007 | Geyer et al. | |
| 7,534,304 | B2 | 5/2009 | Conrad et al. | |
| 7,614,162 | B2 * | 11/2009 | Renzo | 34/603 |
| 2004/0083769 | A1 | 5/2004 | Kim et al. | |
| 2004/0089031 | A1 | 5/2004 | Kim et al. | |
| 2006/0006661 | A1 | 1/2006 | Kim et al. | |
| 2006/0265899 | A1 * | 11/2006 | Renzo | 34/603 |
| 2006/0265959 | A1 | 11/2006 | Renzo | |
| 2007/0051012 | A1 | 3/2007 | Schoene | |
| 2011/0023316 | A1 * | 2/2011 | Schone | 34/88 |
| 2011/0023559 | A1 * | 2/2011 | Schone | 68/212 |
| 2011/0023560 | A1 * | 2/2011 | Schuck et al. | 68/212 |
| 2011/0023561 | A1 * | 2/2011 | Murrell et al. | 68/212 |
| 2011/0025177 | A1 * | 2/2011 | Schone | 312/228 |
| 2011/0025178 | A1 * | 2/2011 | Schone | 312/228 |

FOREIGN PATENT DOCUMENTS

| | | | |
|---|---|---|---|
| DE | 3631377 | A1 * | 2/1987 |
| EP | 1762650 | A2 | 4/2007 |
| WO | WO 2005059228 | A2 * | 6/2005 |

* cited by examiner

*Primary Examiner* — Stephen M. Gravini
(74) *Attorney, Agent, or Firm* — James E. Howard; Andre Pallapies

(57) ABSTRACT

A household appliance includes a housing having an opening for accessing an interior of the housing, a tub disposed inside the housing and having a rotating drum therein for receiving laundry through the opening, and a door assembly having a see-through portion for viewing into the tub and being pivotably coupled to the housing and movable between an open position and a closed position. The door assembly includes a door frame and a front ring coupled directly or indirectly to the door frame. The front ring includes a front face having an outside and inside edge, the inside edge defining an opening that substantially corresponds to the see-through portion, and a recessed rear face on an opposite side of the front ring from the front face, wherein the recessed rear face includes a handle portion extending around at least a portion of the front ring.

30 Claims, 24 Drawing Sheets

FRONT RING FOR A HOUSEHOLD APPLIANCE DOOR

CROSS-REFERENCES TO RELATED APPLICATIONS

This application is related to applicant's co-pending U.S. applications, which are filed concurrently herewith, titled "DOOR HOOK FOR A HOUSEHOLD APPLIANCE DOOR", U.S. Ser. No. 12/533,033; "DOOR BOWL FOR A HOUSEHOLD APPLIANCE DOOR", U.S. Ser. No. 12/533,038; "DOOR HINGE FOR A HOUSEHOLD APPLIANCE DOOR", U.S. Ser. No. 12/512,343; "DOOR FRAME FOR A HOUSEHOLD APPLIANCE DOOR", U.S. Ser. No. 12/512,333; "OVERMOLD SEAL AND RAMP FOR A HOUSEHOLD APPLIANCE DOOR", U.S. Ser. No. 12/512,325; and "INNER RING HAVING A FUNNEL ELEMENT FOR A HOUSEHOLD APPLIANCE DOOR", U.S. Ser. No. 12/512,314, each of which is incorporated herein by reference in its entirety.

FIELD OF THE INVENTION

The present invention is directed toward a household appliance, and more particularly, a door of a household appliance having a see through portion, and more particularly to a front ring of a door of a household appliance.

BACKGROUND OF THE INVENTION

Household appliances, such as clothes washers and dryers, generally include a door that covers an opening for accessing the interior of the appliance. Such clothes washers or dryers commonly include a housing, a rotating drum disposed within the housing, and a driver device for driving the rotating drum. In operation, the door of the appliance is opened and clothes or laundry are inserted into the washer or dryer through the opening and placed in the rotating drum and the door is then closed.

Front-load clothes washers and dryers, which have a door positioned on the front of the appliance, have become increasingly popular in recent years for household use. Such front-load washers and dryers commonly include glass or see-through portions in the door to allow an operator to monitor the laundry while it is in the rotating drum.

Such household appliances commonly are positioned side-by-side in a laundry room of a home. In the case of front-load washers and dryers, the door of each household appliance opens out from the front of the appliance. The location of the door hinge determines whether the door is a right-hand opening door or left-hand opening door. The location of water and drain hook-ups, or power outlets, commonly determines whether the dryer can be located on the right hand side or the left hand side of the washer.

In some cases, the proximity of the appliances to walls or doorways, other appliances, or furniture, etc. may affect the location of the appliances. In these cases, it may be desirable to change the swing of the appliance door from a right-hand swing to a left-hand swing, for example, to permit easy access to the appliance.

A dryer door commonly can be configured to be either a right hand door or a left hand door. The dryer door commonly can be configured by the user to open from either side. That is, the dryer door and latch commonly are removable by the user to change the door between a left-hand opening door or a right-hand opening door.

In contrast, the location of the door hinge on a washer door commonly is fixed such that the washer only has a single door configuration. That is, the washer door commonly opens only from one side and cannot be reconfigured by the user to open from a different side.

Commonly, a washer and dryer, which are produced by the same manufacturer and are part of the same model line, have a similar appearance from the outside, since such appliances are often purchased together and installed side-by-side. Despite their similar appearance from the exterior, some of the features, functions, or designs of the washer door can be different from many of those of the dryer door.

The number and type of parts, steps, time, and cost associated with manufacturing and installing the conventional washer door on a washer can be dramatically different from those of a dryer door, which may affect the efficiency, cost, and time of manufacturing a washer or dryer. Moreover, different manufacturing lines or stations may be needed to manufacture a washer door compared to a dryer door, which may affect the efficiency, cost, and time of manufacturing a washer or dryer.

In many conventional household appliances, the appliance door includes a handle formed on an exterior of the door that can be grasped by a user to open and close the appliance door. The handle commonly has a very limited range that can be grasped by the user such that the user applies force to the door at a predetermined location.

SUMMARY OF THE INVENTION

These problems and others are addressed by the present invention, a first exemplary embodiment of which comprises a household appliance including a housing having an opening for accessing an interior of the housing, a tub disposed inside the housing, the tub having a rotating drum therein for receiving laundry through the opening, and a door assembly having a see-through portion for viewing into the tub, the door assembly being pivotably coupled to the housing and movable between an open position for accessing the opening of the housing and a closed position for closing the opening of the housing, wherein the door assembly includes a door frame, and a front ring coupled directly or indirectly to the door frame, wherein the front ring includes a front face having an outside edge and an inside edge, wherein the inside edge defines an opening in the front face that substantially corresponds to the see-through portion of the door, a recessed rear face on an opposite side of the front ring from the front face, wherein the recessed rear face includes a handle portion extending around at least a portion of the front ring.

Another exemplary embodiment of the invention comprises a front ring for a door assembly of a household appliance, wherein the household appliance includes a housing having an opening for accessing an interior of the housing, a tub disposed inside the housing, the tub having a rotating drum therein for receiving laundry through the opening, and a door assembly having a see-through portion for viewing into the tub, the door assembly being pivotably coupled to the housing and movable between an open position for accessing the opening of the housing and a closed position for closing the opening of the housing, wherein the front ring comprises a front face having an outside edge and an inside edge, wherein the inside edge defines an opening in the front face that corresponds to the see-through portion of the door, a recessed rear face on an opposite side of the front ring from the front face, wherein the recessed rear face includes a handle portion extending around at least a portion of the front ring.

The exemplary embodiments of the present invention provide a front ring for an appliance door that can be universal to both a washer and the dryer, thereby reducing manufacturing costs and complexity of the household appliances.

The exemplary embodiments of the present invention provide a front ring for an appliance door that can only be assembled in two possible orientations; one orientation for a right-hand door and one orientation for a left-hand door, thereby reducing assembly time and ensuring proper assembly.

The exemplary embodiments provide important advantages in that a user can open and close the door by grasping the front ring at any location along a handle portion, thereby providing a wide range for a user to grasp the door and apply force to open the door.

Additionally, the exemplary embodiments of the present invention provide a front ring for an appliance door in which the handle portion is concealed from view.

Another exemplary embodiment of the present invention provides a front ring for an appliance door having screw points for securing the front ring to the door frame at or near the edge of the door frame, thereby permitting the screw points for assembling the other components of the door, which may be subject to much higher forces, to be located in a more robust or higher strength portion of the door frame, such as at or near a center portion between the outer edge and the inner edge of the door frame.

Moreover, the exemplary embodiments of the present invention may improve accessibility of the screw points, thereby providing easy access to these screws for easily and efficiently attaching the front ring to the door assembly after the door has been assembled, or after the assembled door has been installed on the appliance housing. In this manner, the front ring and/or the plastic cover panel can be repaired or replaced with little effort.

Furthermore, the exemplary embodiments can provide a concealed handle portion that reduces the exposure of the handle portion to dirt, fingerprints, grime, etc., while also improving the aesthetic appearance of the appliance.

Other features and advantages of the present invention will become apparent to those skilled in the art upon review of the following detailed description and drawings.

BRIEF DESCRIPTION OF THE DRAWINGS

These and other exemplary aspects and features of embodiments of the present invention will be better understood after a reading of the following detailed description, together with the attached drawings, wherein.

DETAILED DESCRIPTION

Figure 2:
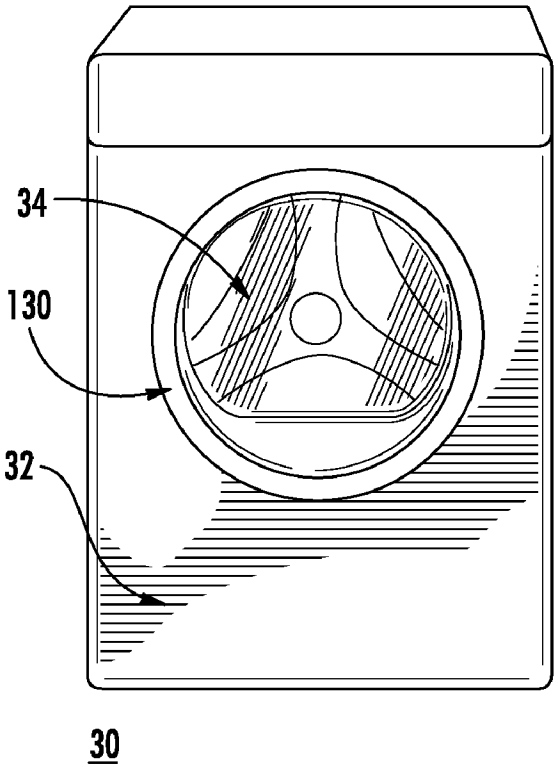
FIG. 2 illustrates a front view of another household appliance according to an embodiment of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-10B illustrate exemplary embodiments of a household appliance.

Figure 1:
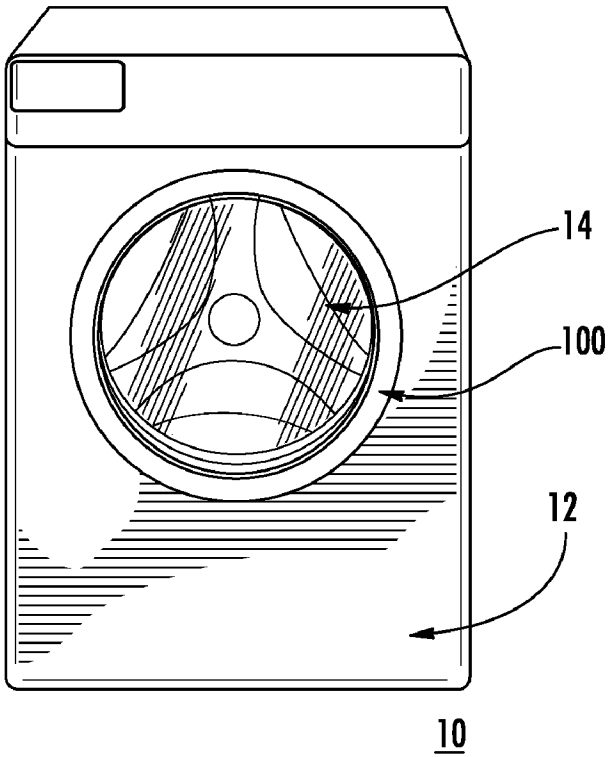
FIG. 1 illustrates a front view of a household appliance, according to an embodiment of the present invention.

FIG. 1 illustrates a household appliance 10, for example, a washer, having a housing 12 and a door 100 connected to the housing 12. The door 100 is mounted with a hinge to pivot with respect to the housing 12 between an open condition and a closed condition. FIG. 1 shows the door 100 in the closed condition. A rotating drum (not illustrated) and a drive device (not illustrated) for driving the rotating drum are disposed within the housing 12. The rotating drum receives clothes or laundry items for washing the items. FIG. 1 illustrates the door 100 on a horizontal axis washer 10. The door 100 having the see-through portion 14 can also be used with a washer having a vertical axis, or with washing machines having either a horizontal or vertical axis, or an axis at an angle with respect to the horizontal or vertical axis of the rotating drum.

The washer 10 can include an opening for accessing the rotating drum in the interior of the housing 12. The housing 12 of the washer 10 can have a hinge mounting surface configured to receive a hinge for pivoting the door 100 with respect to the washer 10. The hinge and door 100 will be described in more detail below. The hinge mounting surface can be located along the perimeter of the opening. The housing 12 can include a support surface or stamping that receives a door hook receptacle. The door hook receptacle can be configured to engage a door hook 600 of the door 100 for retaining the door 100 in a closed position.

FIG. 2 illustrates a household appliance 30, for example, a dryer, having a housing 32 and a door 130 connected to the housing 32. The door 130 is mounted with a hinge to pivot with respect to the housing 32 between an open condition and a closed condition. FIG. 2 shows the door 130 in the closed condition. A rotating drum (not illustrated) and a drive device (not illustrated) for driving the rotating drum are disposed within the housing 32. The rotating drum receives clothes or laundry items for drying the items. The dryer 30 also can include a heating unit (not illustrated), such as a gas heating unit or an electric heating unit, disposed within the housing 32 for applying heat to the laundry within the rotating drum. FIG. 2 illustrates the door 130 on a horizontal axis dryer 30.

The dryer 30 can include an opening for accessing the rotating drum in the interior of the housing 32. The housing 32 of the dryer 30 can have one or more hinge mounting surfaces or stampings 38 configured to receive a hinge for pivoting the door 130 with respect to the dryer 30. The hinge and door 130 will be described in more detail below. The hinge mounting surfaces can be located along the perimeter of the opening and at more than one location to facilitate changing the swing of the door 130 between a left-hand opening door and a right-hand opening door by the user. For example, the hinge mounting surfaces can be located on opposite sides of the opening.

The housing 32 can include one or more support surfaces or stampings that receive a door latch receptacle. The door latch receptacle can be configured to engage a door hook of the door 130 for retaining the door 130 in a closed position. The support surfaces can be located adjacent to or within the hinge mounting surfaces to facilitate changing the swing of the door 130 between a left-hand opening door and a right-hand opening door by the user.

Figure 3A:
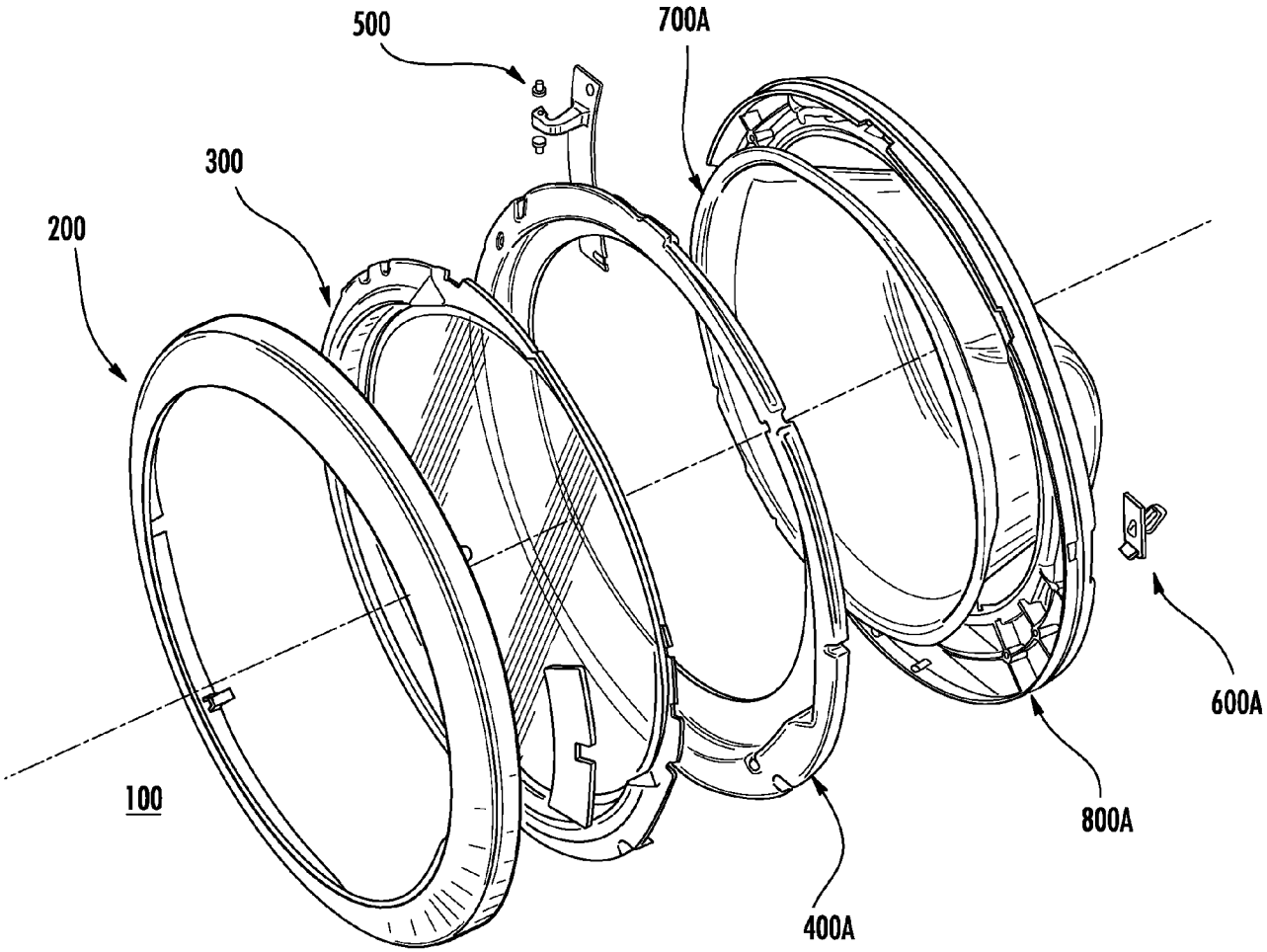
FIG. 3A illustrates an exploded, front perspective view of the door of FIG. 1.
Figure 3B:
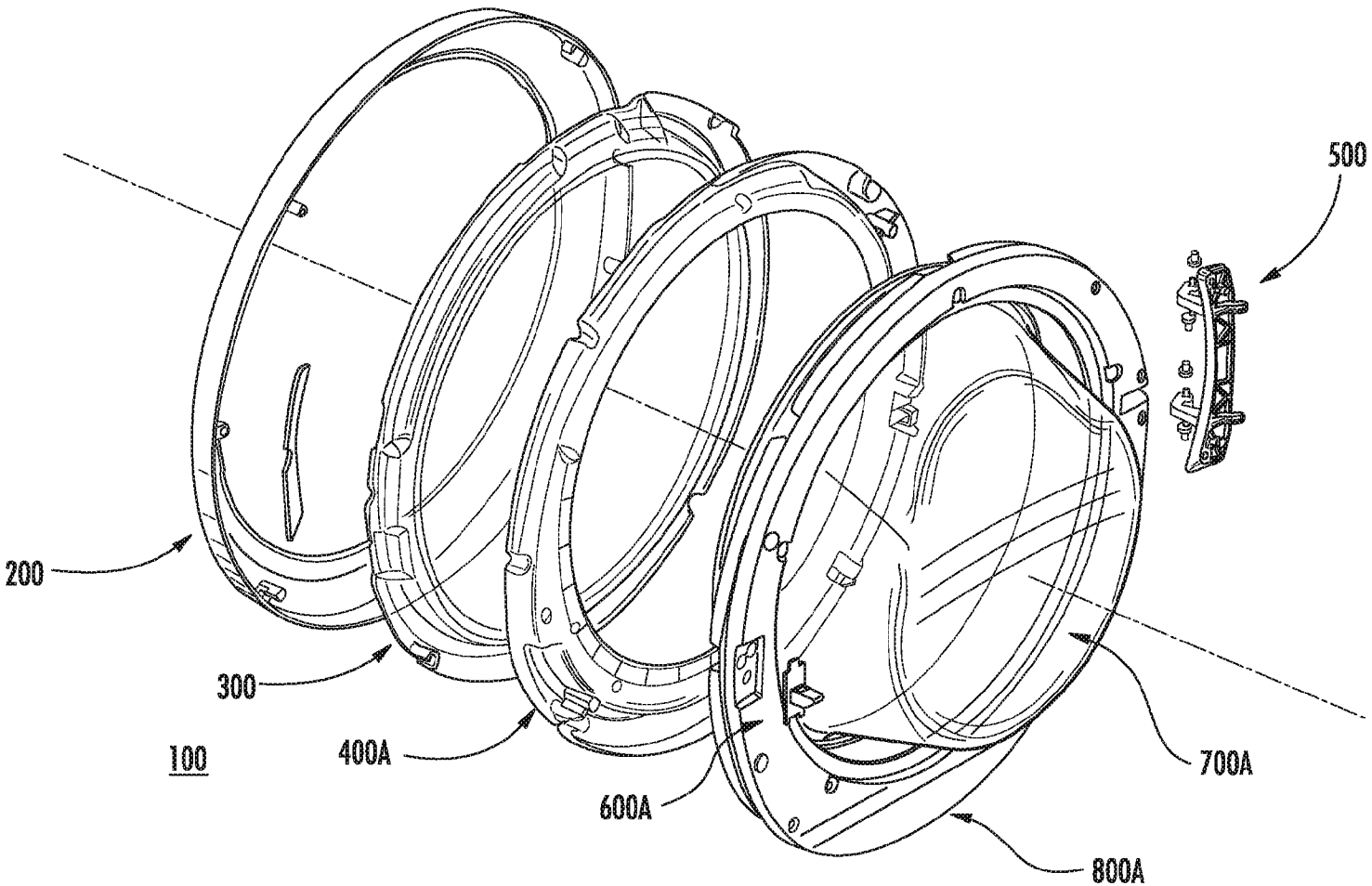
FIG. 3B illustrates an exploded, rear perspective view of the door of FIG. 1.
Figure 3E:
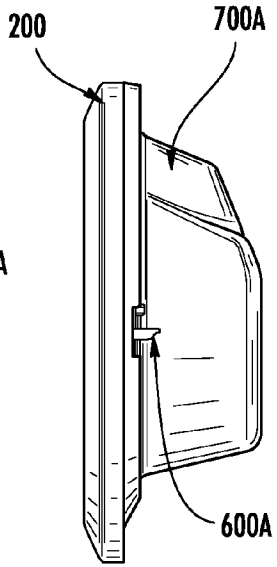
FIG. 3E illustrates a side view of the assembled door of FIG. 1.

FIGS. 3A and 3B illustrate exploded assembly views of an exemplary arrangement of a washer door 100 of FIG. 1. The door 100 includes a front ring 200, a plastic cover panel 300, an inner ring 400A, a door hinge 500, a door hook or latch 600A, a glass bowl 700A, and a door frame 800A, among other features. The features of each of these components will be described in more detail below.

Figure 3D:
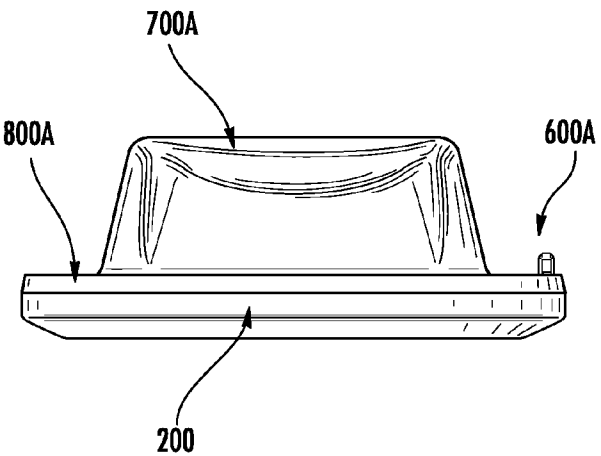
FIG. 3D illustrates a top down view of the assembled door of FIG. 1.
Figure 3C:
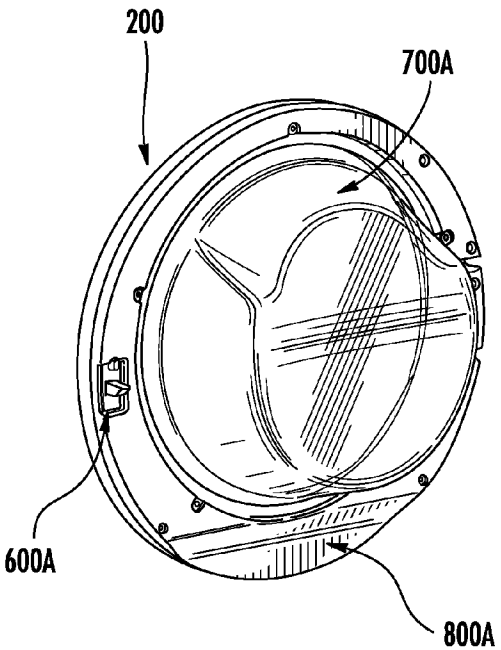
FIG. 3C illustrates a rear perspective view of the assembled door of FIG. 1.

FIGS. 3C-3D illustrate an assembled washer door 100 of FIG. 1 having a front ring 200, a door frame 800A, a glass bowl 700B, and a door hook 600A.

Figure 4A:
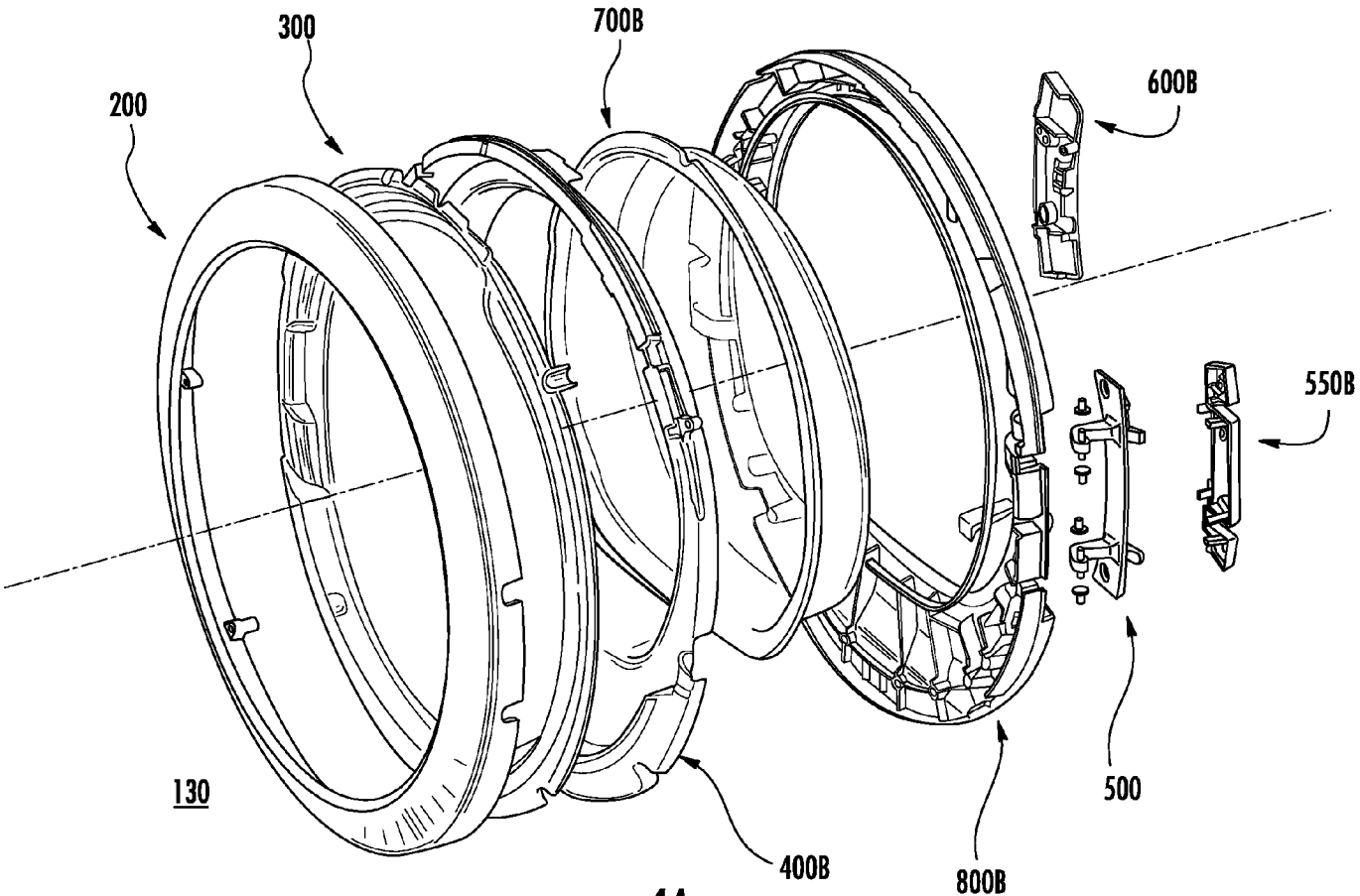
FIG. 4A illustrates an exploded, front perspective view of the door of FIG. 2.
Figure 4B:
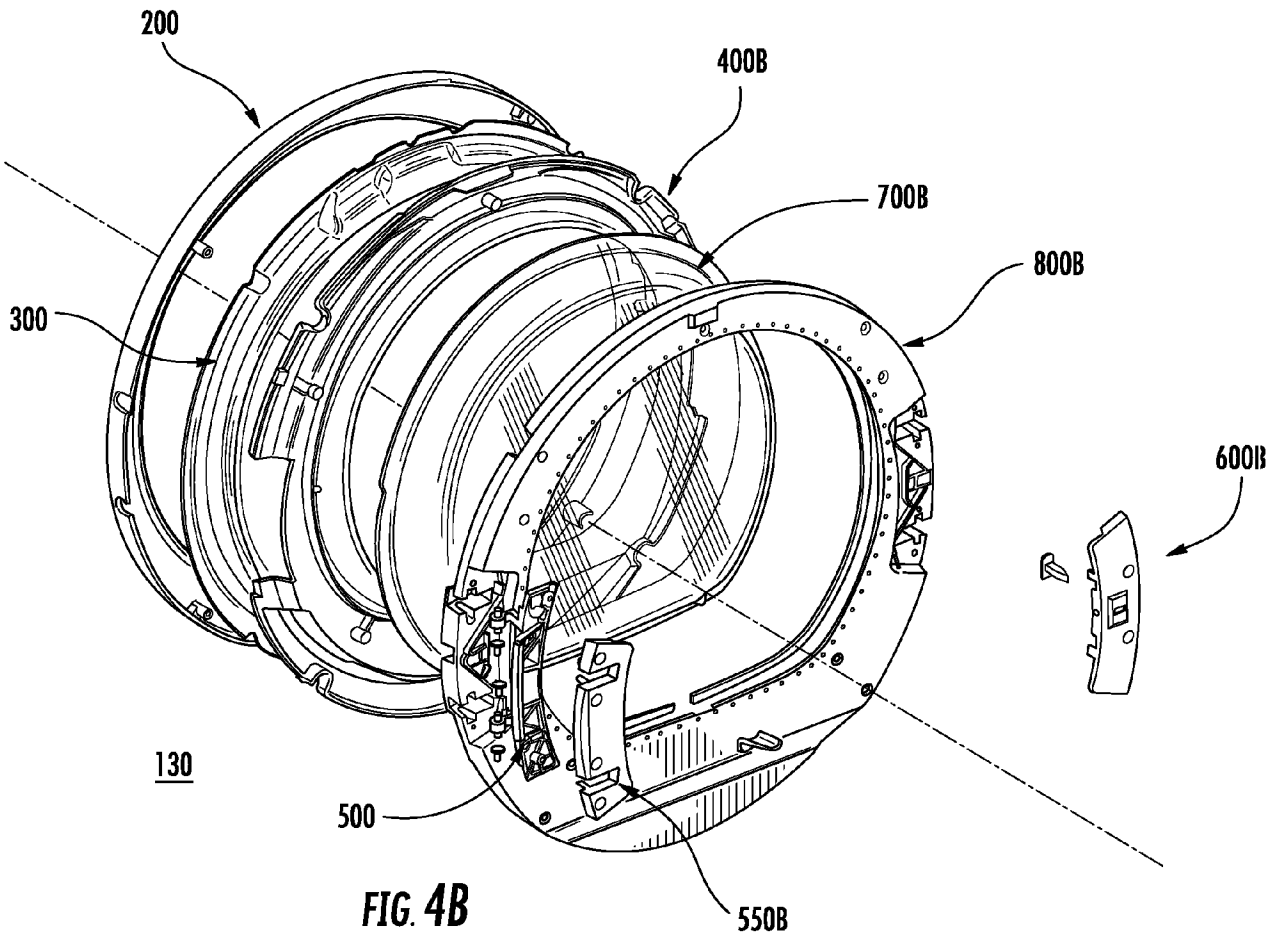
FIG. 4B illustrates an exploded, rear perspective view of the door of FIG. 2.

FIGS. 4A and 4B illustrate exploded assembly views of an exemplary arrangement of a dryer door 130 of FIG. 2. The door 130 includes the front ring 200, the plastic cover panel 300, an inner ring 400B, the door hinge 500, a door striker 600B, a glass bowl 700B, and a door frame 800B, among other features. The features of each of these components will be described in more detail below.

Figure 5B:
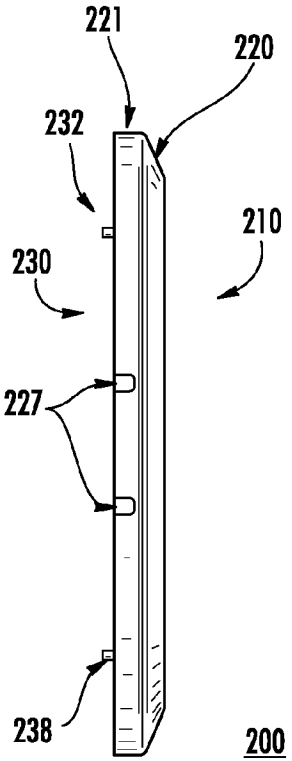
FIG. 5B illustrates a side view of a front ring of a door according to an embodiment of the invention.
Figure 5A:
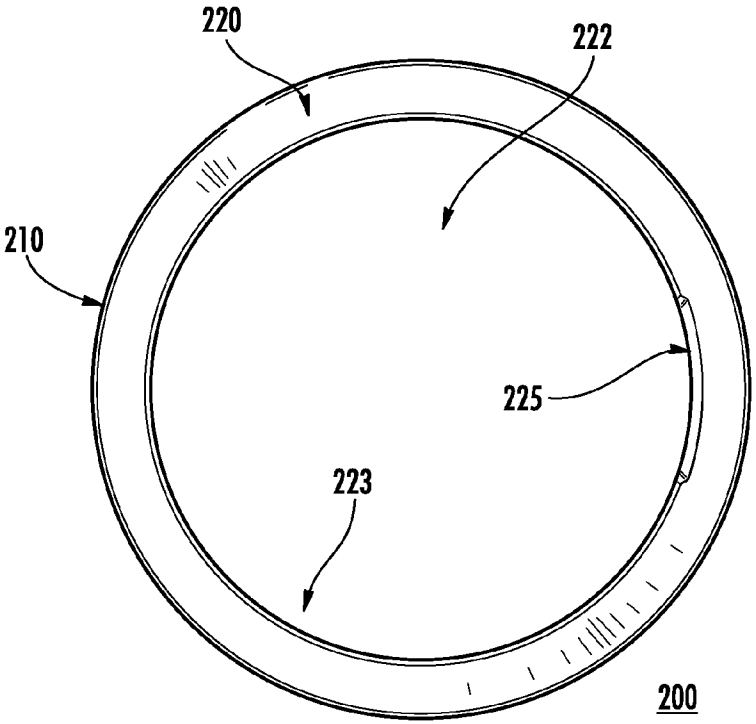
FIG. 5A illustrates a front view of a front ring of a door according to an embodiment of the invention.
Figure 5C:
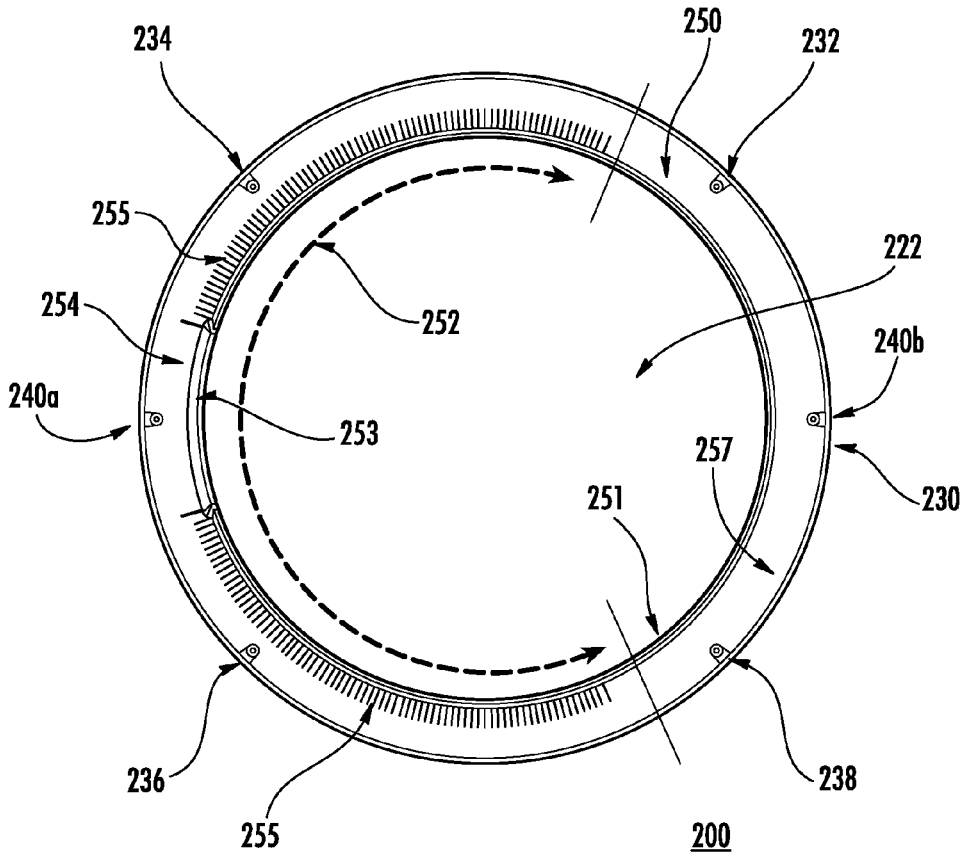
FIG. 5C illustrates a rear view of a front ring of a door according to an embodiment of the invention.

With reference to FIGS. 5A-5C, exemplary embodiments of a front ring 200 will now be described.

As shown in FIGS. 5A-5C, an exemplary embodiment of the front ring 200 can have a substantially circular shape when viewed from the front side 210. However, other shapes are contemplated within the spirit and scope of the invention.

In an exemplary embodiment, the front ring 200 can be configured to correspond to both the frame 400A of the washer 10 and the frame 400B of the dryer 30. That is, the front ring 200 can be configured to be universal or common to both a washer door 100 and a dryer door 130. The front ring 200 can include an opening 222 that corresponds to the see-through portion 14 of the washer door 100 and the dryer door 130. The opening 222 can have, for example, a circular or oval shape, as illustrated. However, in other exemplary embodiments, the opening can have other shapes. The opening 222 can be centered (e.g., concentric) within the front ring 200, or off-center. For example, in the exemplary embodiment illustrated, a center of the opening 222 is offset from, or above, a center of the front ring 200 such that a distance from the opening 222 to the outside edge of the front ring is greater at the bottom portion of the washer door 100 or the dryer door 130 than at the top portion of the washer door 100 or the dryer door 130.

The front ring 200 can be configured to work in conjunction with, or cooperate with, the plastic cover panel 300, which in turn can be configured to work in conjunction with, or cooperate with, the inner ring 400A or 400B. The plastic cover panel 300 and the inner ring 400A, 400B, as well as the relationship between these features and the front ring 200, will be described in more detail below.

As shown in FIGS. 5A and 5B, the front side 210 of the front ring 200 can include a face or surface 220, such as a beveled surface. The surface 220 can be, for example, colored, textured, smooth, or wrapped in metal, such as stainless steel, to provide a desired cosmetic appearance for the door assembly. The surface 220 can include a tapered edge 223 extending around a perimeter of the opening 222 and forming a lip 251 on the rear side of the front ring 220, as shown in FIG. 5C. The surface 220 also can include a tapered or beveled edge portion 225 corresponding to a location of a handle 254, for example, for visually or physically identifying the optimum handle location for opening and closing the door. The front ring 200 can include a side surface 221, extending in a direction of an axis of the opening 222. The side surface 221 can include hinge clearance features 227.

The rear side 230 can include a recessed rear face 250. The recessed rear face 250 can be bordered by an inner wall 257 of the side surface 221 and the lip 251, extending around the perimeter of the opening 222. The inner wall 257 can include a beveled or tapered surface 253 corresponding to the tapered or beveled edge portion 225.

The rear face 250 can include a handle portion 252 extending at least a portion of the way around the perimeter of the opening 222 of the front ring 200. As shown in FIGS. 5B, and 5C, the handle portion 252 can be symmetrical with respect to the front ring 200, and more particularly, with respect to the screw points 240*a*, 240*b*, such that the front ring 200 can be universally used for either a right hand door or a left hand door. Also, the screw points 232, 234, 236, and 238 can be symmetrical.

In an exemplary embodiment, the handle portion 252 can include a grip portion 254. The grip portion 254 can include gripping means or a gripping feature 255, such as recessed grooves, finger grooves, elevated portions, bumps, or textures, or a separate piece that provides a gripping surface, such as a rubber surface, a textured surface, etc. The handle portion 252 can extend around at least a portion of the rear face 250. The handle portion 252 and/or the gripping feature 255 can be continuous or intermittent along the rear face 250. In this manner, the front ring 200 can be changed from a right-hand configuration to a left-hand configuration, for example for a dryer door 30, by rotating the front ring 200 by 180° in either direction.

The exemplary embodiments provide important advantages in that a user can open and close the door by grasping the front ring 200 at any location along the handle portion 252. The handle portion 252 provides a wide range for a user to grasp the door and apply force to open the door.

Additionally, the handle portion 252 is concealed from view behind the front ring 200. The concealed handle portion 252 provides a smooth exterior appearance that reduces the encroachment of the appliance into the space immediately in front of the appliance. In this manner, the front ring 200 can provide a user-friendly door handle that is less susceptible to dirt, fingerprints, etc. because the handle portion 252 is concealed. The front ring also can improve the aesthetic appearance of the appliance to the user.

The front ring 200 can be configured to work in conjunction with, or cooperate with, the plastic cover 300 and/or the inner ring 400A of the washer (or 400B of the dryer). The plastic cover 300 and/or the inner ring 400A (or 400B) can include a corresponding recessed portion or lip that corresponds to the handle portion 252 of the front ring 200 and provides clearance for gripping the handle portion 252 of the front ring 200. The recessed portion or lip of the plastic cover 300 and/or the inner ring 400A (or 400B) can extend at least a portion of the way around the perimeter of the door, and can include one or more indentions corresponding to the handle location(s) 254 of the front ring 200.

As shown in FIG. 5C, the rear side of the front ring 200 can include a plurality of fastener points, such as screw points (e.g., 232, 234, 236, 238, 240*a*, and 240*b*), spaced around the perimeter of the front ring 200 for securing the front ring 200 to other components of the door assembly.

In an exemplary embodiment, the front ring 200 can be secured to the door frame 800A (or 800B) using, for example, a plurality of screws inserted from the rear of the door assembly through corresponding openings or screw points in the door frame 800A (or 800B), then through clearance features or openings on the plastic cover panel 300 and the inner ring 400A (or 400B), and into the screw points 232, 234, 236, 238, 240*a*, and 240*b*.

The exemplary embodiments are not limited to assembly using screws. In other exemplary embodiments, these screw points can be other types of connection points, attachments, or receptacles for receiving fasteners such as screws, bolts, plastic fasters, or the like, or for mating with other fasteners.

In an exemplary embodiment, one or more screw points 240*a* and 240*b* can be provided at or near a location corresponding to a location of a door handle 254 to distribute or transfer the force applied at the handle location to the door frame 800A (or 800B).

Additionally, the screw points (e.g., 232, 234, 236, 238, 240*a*, and 240*b*) can be configured such that the front ring 200 can only have a single orientation for assembly for a left-hand door and only a single orientation for assembly for a right-hand door, as shown in FIGS. 5B and 5C. For example, in the disclosed exemplary embodiment, the screw points 232, 234, 236, 238, 240*a*, and 240*b* are symmetrically arranged. In this manner, the front ring 200 can only be assembled in two possible orientations; one orientation for a right-hand door and one orientation for a left-hand door, thereby reducing assembly time and ensuring proper assembly. The right-hand door position is oriented 180 degrees from the left-hand door position. The correct orientation of the two possible orientations is easily selected during assembly based on the left-hand or right-hand hinge, since the hinge will obstruct the assembly if front ring 200 orientation does not correspond to the hinge orientation.

As explained above, the front ring 200 can be universal to both the washer 10 and the dryer 30, thereby reducing manufacturing costs and complexity of the household appliances.

As explained above, the front ring 200 can be coupled to the door frame 800 at each of the screw points (e.g., 232, 234, 236, 238, 240*a*, and 240*b*). More particularly, the front ring 200 can be secured to the door frame 800A (or 800B) using, for example, a plurality of screws inserted from the rear of the door assembly through corresponding openings or screw points in the door frame 800A (or 800B), then through clearance features or openings on the plastic cover panel 300 and the inner ring 400A (or 400B), and into the screw points 232, 234, 236, 238, 240*a*, and 240*b*. The screw points (e.g., 232, 234, 236, 238, 240*a*, and 240*b*) can couple the front ring 200 to the door frame 800A (or 800B). In the illustrated exemplary embodiment, the front ring 200 can secure or press fit the plastic cover panel 300 between the front ring 200 and the inner ring 400A (or 400B), which can be coupled to the door frame 800A (or 800B) using separate attachment points.

In this manner, the front ring 200 is not necessary for assembly of the primary components of the door, which are needed for functional operation of the door. The front ring 200 can be removed or disassembled from the door frame 800A (or 800B) without affecting the functionality of the washer door 100 or the dryer door 130, respectively. The front ring 200 can be easily and efficiently removed and/or attached to simplify assembly, facilitate repairs, cosmetic changes, etc. without affecting the function of the washer door 100 or the dryer door 130. Moreover, in the illustrated exemplary embodiments, the front ring 200 can be easily and efficiently removed and/or attached to facilitate repair or replacement of the plastic cover panel 300, without affecting the function of the washer door 100 or the dryer door 130.

As explained above, the screw points 232, 234, 236, 238, 240*a*, and 240*b* support the front ring 200, or the front ring 200 and the plastic cover panel 300, and therefore, are not subjected to a large amount of forces. In contrast, the door frame 800A (or 800B) and the inner ring 400A (or 400B) are subjected to the weight of the glass bowl, etc.

In this manner, as shown in FIG. 5C, the screw points 232, 234, 236, 238, 240*a*, and 240*b* can be located at or near the outer edge of the front ring 200, which may be of lesser strength than an inner portion of the front ring 200. The corresponding screw points on the door frame 800A (or 800B) also can be located at or near the outer edge of the door frame 800A (or 800B).

By locating the screw points for securing the front ring to the door frame 800A (or 800B) at or near the edge of the door frame, the screw points for assembling the other components of the door, which may be subject to much higher forces, can be located in a more robust or higher strength portion of the door frame 800A (or 800B), such as at or near a center portion between the outer edge and the inner edge of the door frame 800A (or 800B).

Moreover, the accessibility of the screw points may be improved, thereby providing easy access to these screws for easily and efficiently attaching the front ring 200 to the door assembly after the door has been assembled, or after the assembled door has been installed on the appliance housing. Thus, the front ring 200 and/or the plastic cover panel 300 can be repaired or replaced with little effort.

The embodiments are not limited to the disclosed exemplary embodiments. In other exemplary embodiments, the front ring 200 can secure one or more of the plastic cover 300 to the door frame 800A (or 800B).

Figure 6A:
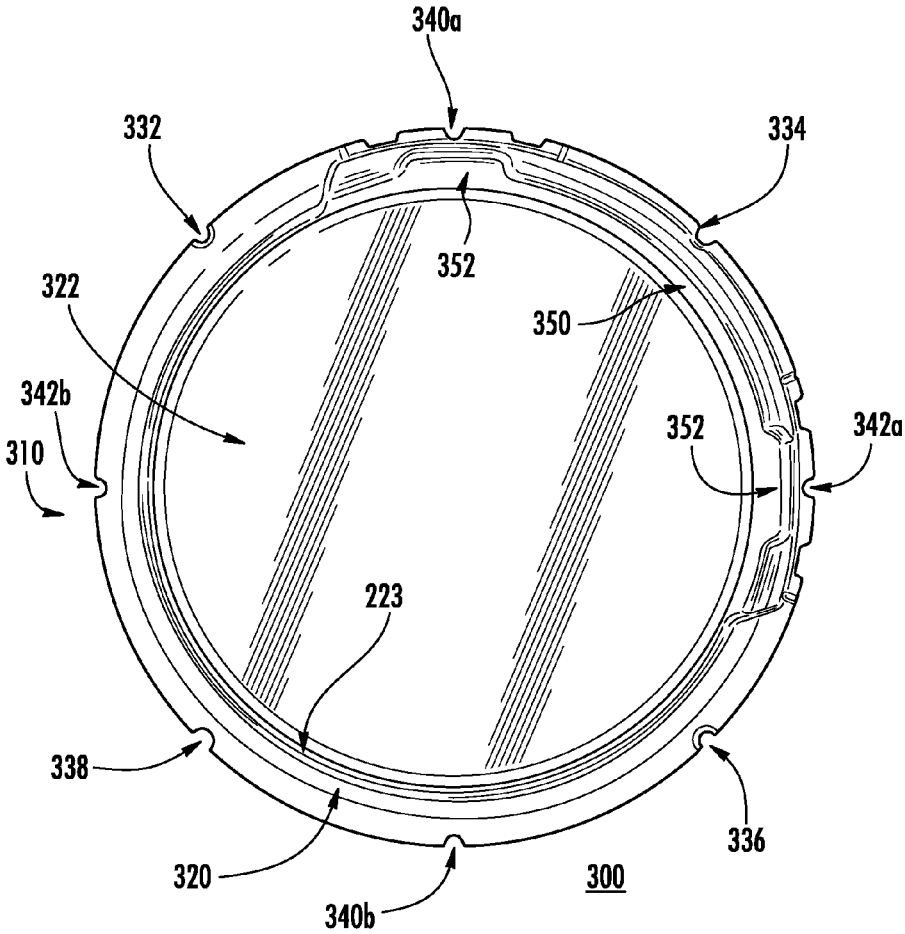
FIG. 6A illustrates a front view of a plastic panel of a door according to an embodiment of the invention.
Figure 6B:
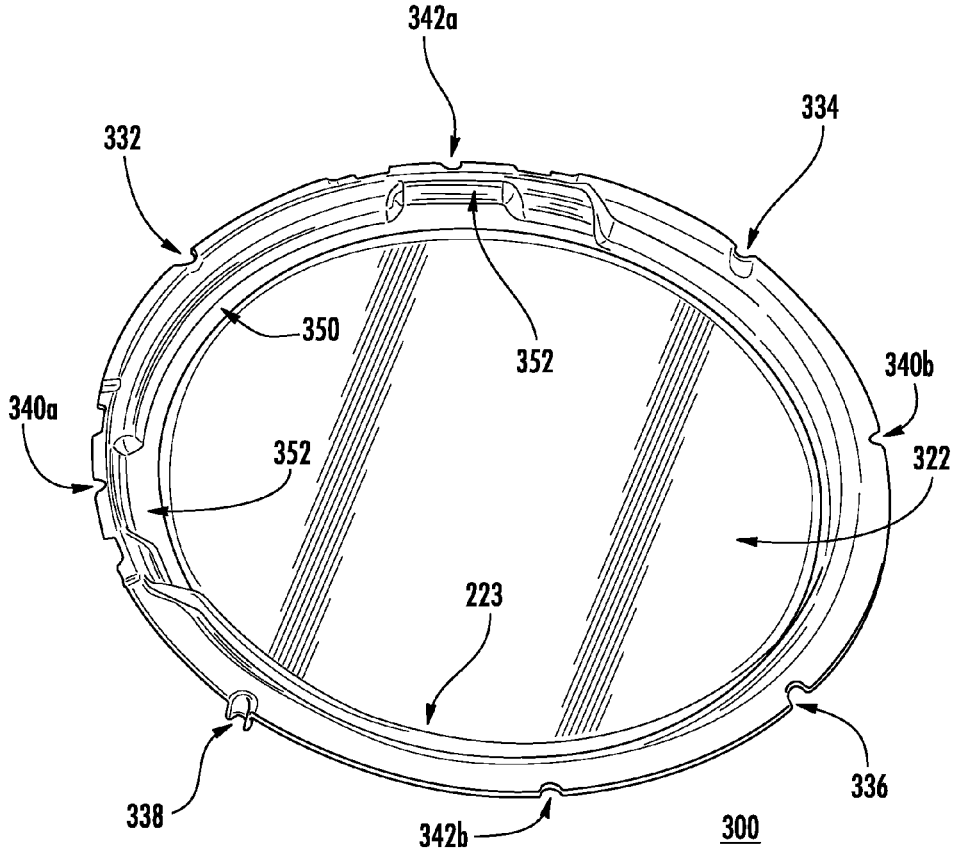
FIG. 6B illustrates a front perspective view of a plastic panel of a door according to an embodiment of the invention.
Figure 6C:
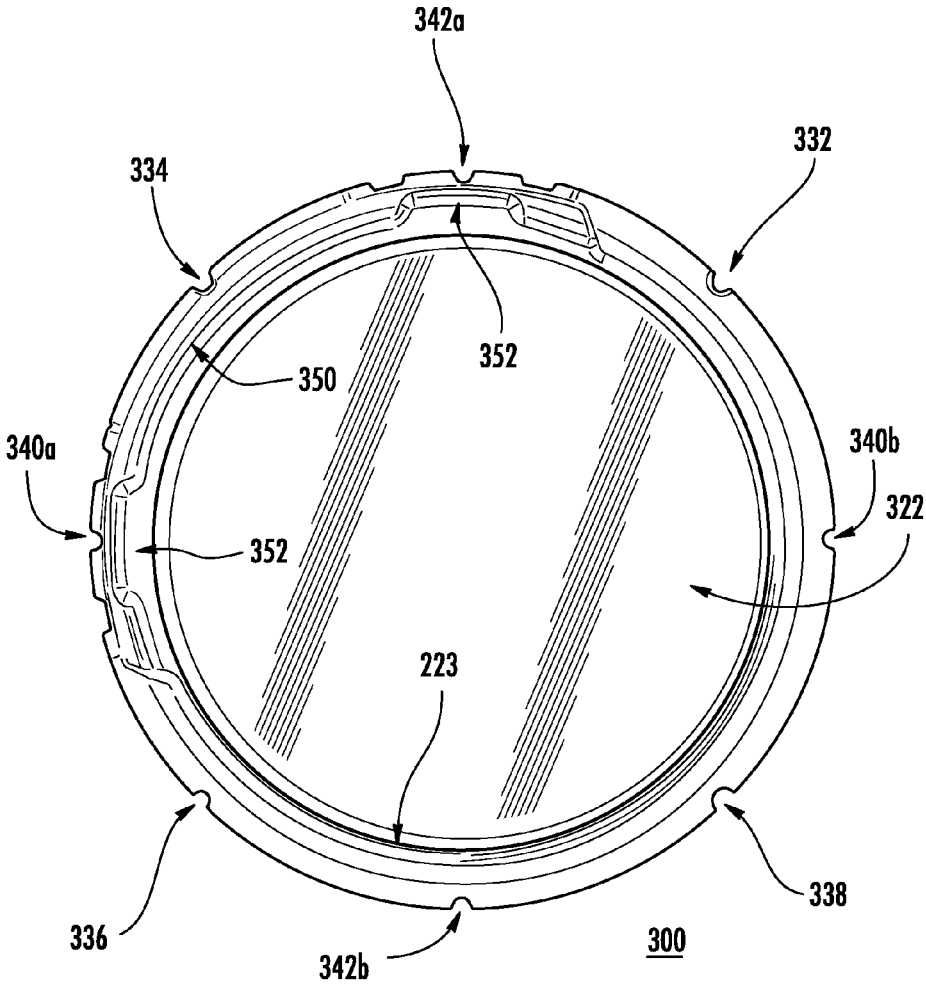
FIG. 6C illustrates a rear view of a plastic panel of a door according to an embodiment of the invention.

With reference to FIGS. 6A-6C, exemplary embodiments of a plastic cover panel 300 will now be described.

As shown in FIGS. 6A-6C, an exemplary embodiment of the plastic cover panel 300 can have a substantially circular shape when viewed from the front side 310. However, other shapes are contemplated within the spirit and scope of the invention.

In an exemplary embodiment, the plastic cover panel 300 can be configured to be universal or common to both a washer door 100 and a dryer door 130. The plastic cover panel 300 can include a see-through portion 322 that corresponds to the see-through portion 14 of the washer door 100 and the dryer door 130. In an exemplary embodiment, the plastic cover panel 300 is formed from a substantially transparent or translucent plastic.

FIGS. 6A and 6B illustrate an exemplary embodiment of the front side 310 of the plastic cover panel 300. FIG. 6C illustrates the plastic cover panel 300 from the rear side.

The plastic cover panel 300 can be configured to work in conjunction with, or cooperate with, the front ring 200 and the inner ring 400A (or 400B). The front side 310 can include a ring portion 320 extending around a perimeter of the see-through portion 322. In an exemplary embodiment, both the ring portion 320 and the see-through portion 322 are formed from a substantially transparent or translucent plastic.

The see-through portion 322 can have, for example, a circular or oval shape, as exemplarily illustrated. However, in other exemplary embodiments, the opening can have other shapes, such as a half-circle, half-oval, square, or rectangle shape, among other shapes. A center point of the see-through portion 222 can be concentric with a center point of the ring portion 320, or disposed off-center from the center point of the ring portion 320. For example, in the exemplary embodiment illustrated, a center of the see-through portion 322 can be offset from, or above, a center of the ring portion 320 such that a thickness of the ring portion 320 (i.e., a distance from the perimeter of the see-through portion 322 to the outside edge of the ring portion 320) is greater at the bottom portion of the washer door 100 or the dryer door 130 than at the top portion of the washer door 100 or the dryer door 130.

The ring portion 320 can include a recessed portion or lip 350 that corresponds to the grip or handle portion 252 of the front ring 200 and provides clearance for gripping the grip or handle portion 252 of the front ring 200. The recessed portion or lip 350 can extend at least a portion of the way around the perimeter of the ring portion 320 of the plastic cover panel 300. In an exemplary embodiment, the recessed portion or lip 350 can include one or more indentions 352 corresponding to one or more handle locations of the front ring 200.

As shown in FIGS. 6A and 6B, the plastic cover panel 300 can include a plurality of fastener points or pockets (e.g., locating features and/or clearance features) 332, 334, 336, and 338, that correspond to the locations of the screw points 232, 234, 236, and 238 of th1e front ring 200. The locating and/or clearance features 332, 334, 336, and 338 can correspond to similar features in the inner ring 400A (or 400B), as described in more detail below.

The locating and/or clearance features 332, 334, 336, and 338 can include, for example, an opening, notch, clearance feature, locating feature, protrusion, screw boss, partial screw boss, or the like that engages the corresponding feature of the inner ring 400A (or 400B) for aligning and positioning the plastic cover panel 300 in an assembled position. The locating and/or clearance features 332, 334, 336, and 338 can provide clearance for fasteners extending from the door frame 800A (or 800B) through clearance features of the inner ring 400A (or 400B) and into the screw points 232, 234, 236, and 238 of the front ring 200.

In an exemplary embodiment, the plastic cover panel 300 can include one or more locating and/or clearance features 340*a*, 340*b*, 342*a*, and 342*b* that correspond to the location(s) of the screw point(s) 240*a*, 240*b* of the front ring 200, which are configured to correspond to a location of a door handle to distribute or transfer the force applied at the handle location to the door frame 800A (or 800B).

The locating and/or clearance features 340*a*, 340*b*, 342*a*, and 342*b* can be symmetrical with respect to one of the locating and/or clearance features (e.g., 334) such that the plastic cover panel 300 can be universally used for either a right hand door or a left hand door.

The locating and/or clearance features 332, 334, 336, 338, 340*a*, 340*b*, 342*a*, and 342*b* can be configured such that the plastic cover panel 300 can only have a single orientation for assembly for a heft-hand door and only a single orientation for assembly for a right-hand door. In an exemplary embodiment, the plastic cover panel 300 can be changed from a right-hand configuration to a left-hand configuration, for example for a dryer door 30, by rotating the plastic cover panel 300 by 90°.

In another exemplary embodiment, the size of one or more of the locating and/or clearance features 332, 334, 336, 338, 340*a*, 340*b*, 342*a*, and 342*b* can be different from a size of the other clearance features such that the plastic cover panel 300 can only have a single orientation for assembly with the inner ring 400A (or 400B). Also, the inner shape of the cover glass can have a shape that matches or corresponds to a shape of the opening 222 of the inner ring.

In yet another exemplary embodiment, one or more of the locating and/or clearance features 332, 334, 336, 338, 340*a*, 340*b*, 342*a*, and 342*b* can include an extension or protrusion configured that engages the corresponding locating and/or clearance feature of the inner ring 400A, 400B. In the illustrated exemplary embodiment, the locating and/or clearance features 334 and 338 have a protrusion. However, the embodiments are not limited to the illustrated exemplary embodiment and other configurations are possible within the spirit and scope of the invention.

As explained above, the plastic cover panel 300 can be universal to both the washer 10 and dryer 30 such that only a single station on the assembly line is needed for installing the front ring for both the washer 10 and dryer 30.

In an exemplary embodiment, the plastic cover panel 300 is disposed between the front ring 200 and the inner ring 400A (or 400B) when the washer door 100 or dryer door 130 is assembled. By securing the front ring 200 to the door frame 800A (or 800B), the plastic cover panel 300 is secured (e.g., press fit) between the front ring 200 and the inner ring 400A (or 400B). In these exemplary embodiments, the plastic cover panel 300 is not necessary for operation of the door assembly. The plastic cover panel 300 can be removed or disassembled from the door frame 800A (or 800B) by removing the front ring 200 without affecting the operation of the washer door 100 or the dryer door 130. According to these exemplary embodiments, the plastic cover panel 300 can be easily and efficiently removed and/or attached to facilitate repairs, cosmetic changes, etc. without affecting the function of the washer door 100 or the dryer door 130.

Figure 7A:
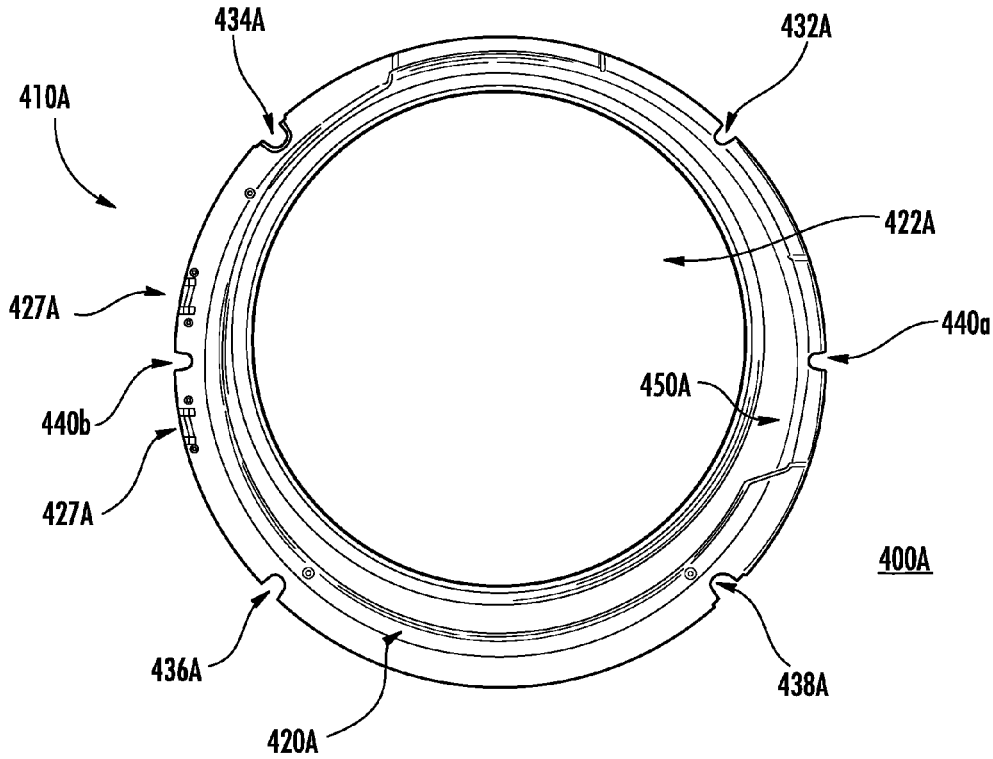
FIG. 7A illustrates a front view of the inner ring of the door of FIGS. 3A, 3B.
Figure 7B:
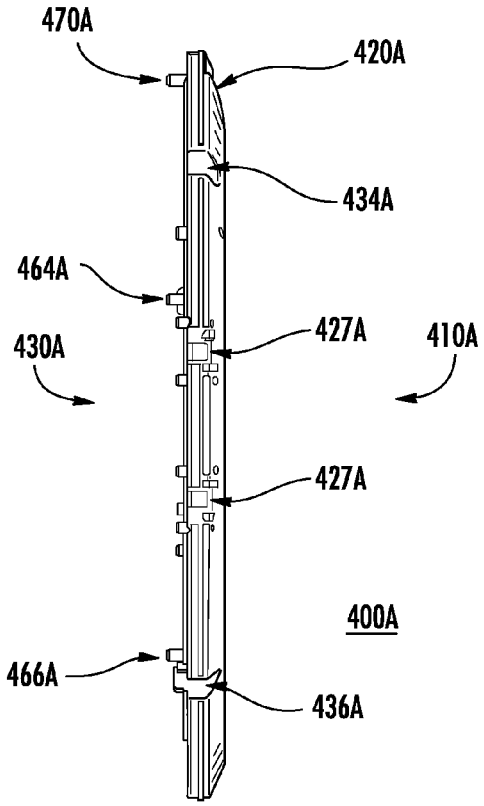
FIG. 7B illustrates a side view of the inner ring of the door of FIGS. 3A, 3B.
Figure 7C:
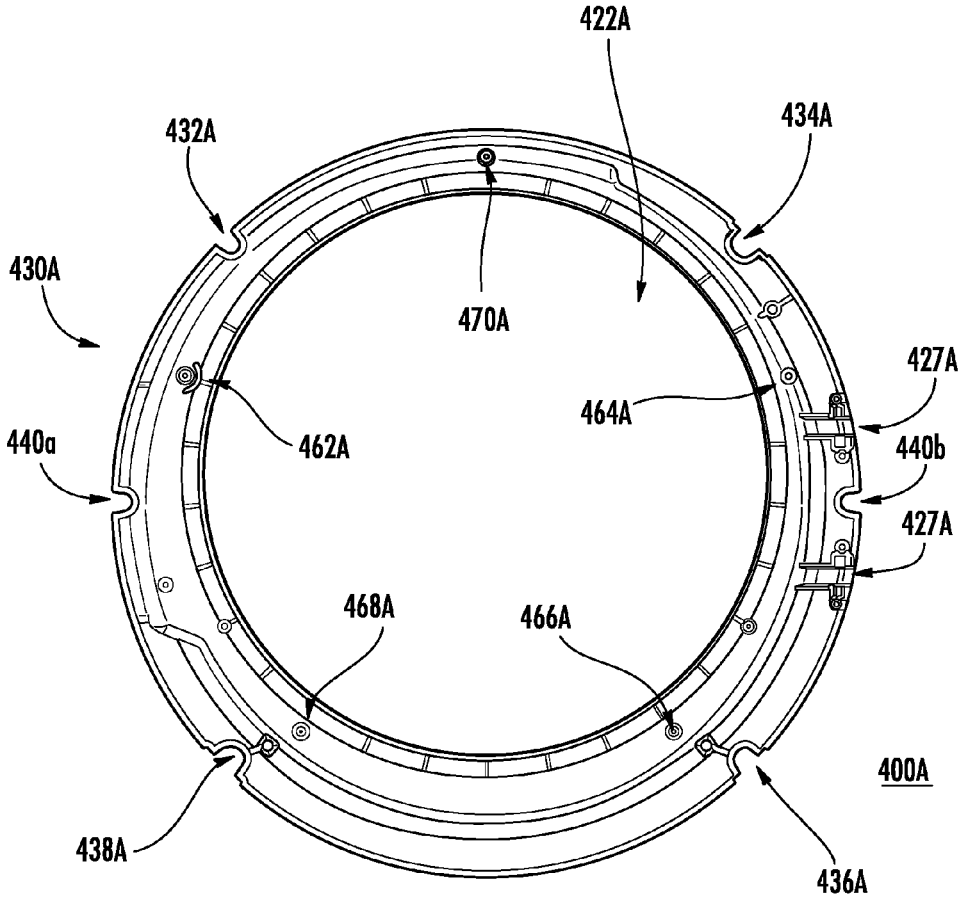
FIG. 7C illustrates a rear view of the inner ring of the door of FIGS. 3A, 3B.

With reference to FIGS. 7A-7C, exemplary embodiments of an inner ring 400A, for example for a washer 10, will now be described.

As shown in FIGS. 7A-7C, an exemplary embodiment of the inner ring 400A can have a substantially circular shape when viewed from the front. However, other shapes are contemplated within the spirit and scope of the invention.

In an exemplary embodiment, the inner ring 400A can be configured to correspond to the front ring 200 and plastic cover or panel 300 of the washer 10 or dryer 30. In an exemplary embodiment, the inner ring 400A can be configured to have features that are particular to a washer door 100.

The inner ring 400A can include an opening 422A that corresponds to the see-through portion 14 of the washer door 100. The opening 422A can have, for example, a circular or oval shape, as illustrated. However, in other exemplary embodiments, the opening can have other shapes.

The opening 422A can be centered (e.g., concentric) within the inner ring 400A, or off-center. For example, in the exemplary embodiment illustrated, a center of the opening 422A is offset from, or above, a center of the inner ring 400A such that a distance from the opening 422A to the outside edge of the inner ring 400A is greater at the bottom portion of the washer door 100 than at the top portion of the washer door 100.

The door frame can be configured to work in conjunction with, or cooperate with, the plastic cover panel 300, which in turn can be configured to work in conjunction with, or cooperate with, the front ring 200.

FIG. 7A illustrates an exemplary embodiment of the front side 410A of the inner ring 400A. The inner ring 400A can include a ring portion 420A. The ring portion 420A can include a recessed portion or lip 450A that corresponds to the grip or handle portion 252 of the front ring 200 and the recessed portion or lip 350 of the plastic cover panel 300, which provide clearance for gripping the grip or handle portion 252 of the front ring 200. The recessed portion or lip 450A can extend at least a portion of the way around the perimeter of the ring portion 420A of the inner ring 400A.

As shown in FIGS. 7A and 7B, the inner ring 400A can include a plurality of locating and/or clearance features 432A, 434A, 436A, and 438A that correspond to the locations of locating and/or clearance features 332, 334, 336, and 338 of the plastic cover panel 300 and the screw points 232, 234, 236, and 238 of the front ring 200. The locating and/or clearance features 432A, 434A, 436A, and 438A can correspond to through holes and/or locating features 832A, 834A, 836A, and 838A of the door frame 800A, as described in more detail below.

The locating and/or clearance features 432A, 434A, 436A, and 438A can include, for example, an opening, notch, clearance feature, locating feature, protrusion, screw boss, partial screw boss, or the like that engages the corresponding feature of the door frame 800A for aligning and positioning the inner ring 400A in an assembled position. The locating and/or clearance features 432, 434, 436, and 438 can provide clearance for fasteners extending from the door frame 800A such that the fasteners can extend through corresponding clearance features 332, 334, 336, and 338 of the plastic cover panel 300 and into the screw points 232, 234, 236, and 238 of the front ring 200.

In an exemplary embodiment, the inner ring 400A can include one or more locating and/or clearance features 440*a*, 440*b* that correspond to the location of clearance features 340*a*, 340*b*, 342*a*, or 342*b* of the plastic cover panel 300 and the screw points 240*a*, 240*b* of the front ring 200. These features are configured to correspond to a location of a door handle or grab handle to distribute or transfer the force applied at the handle location to the door frame 800A.

The locating and/or clearance features 432A, 434A, 436A, and 438A can be configured such that the inner ring 400A can only have a single orientation for assembly. For example, one or more of the locating and/or clearance features 432A, 434A, 436A, and 438A can have a size different from a size of the other clearance features, such that only a single orientation is possible. In this exemplary embodiment, the size of each clearance feature can correspond to a size of the locating and/or clearance features 332, 334, 336, 338, 340*a*, 340*b*, 342*a*, and 342*b* of the front ring 200 and plastic cover 300. In other exemplary embodiments, the locating and/or clearance features can have a different shape, or a different size and shape, among other things.

In the illustrated exemplary embodiment, the locating and/or clearance features 434A and 438A can be larger than the other clearance features to accommodate both the locating features of the front ring 200 and the locating and/or clearance features 334 and 338 of the plastic cover 300, which can include an extension. The embodiments are not limited to the illustrated exemplary embodiment and other configurations are possible within the spirit and scope of the invention.

The inner ring 400A can include hinge pockets 427A for receiving a hinge 500, which will be described in more detail below. In an exemplary embodiment of the washer door 10, the hinge 500 can be secured or captured between the inner ring 400A and the washer frame 800A. In this manner, the inner ring 400A and the washer frame 800A act as a single part and the forces on the hinge 500 are transferred over both the inner ring 400A and the washer frame 800A.

The washer door 10 may not be configured to be disassembled by the end user. Hence, the inner ring 400A and the door frame 800A can be configured to have the hinge pockets 427A and 827A on a single side of the door, such that the washer door 10 can be configured to swing in only a single direction.

In an exemplary embodiment, the hinge pockets 427A can be 180° hinge pockets formed between the inner ring 400A and the washer frame 800A. The corresponding features of the inner ring 400A and the washer frame 800A can be conical shaped features that engage one inside the other.

With reference to FIG. 7B, the rear side 430A will now be described.

The inner ring 400A can include a plurality of fastener points, such as screw points 462A, 464A, 466A, 468A, and 470A, which correspond to the fastener points, e.g., screw points 862A, 864A, 866A, 868A, and 870A, of the door frame 800A, which will be described in more detail below. In this manner, the inner ring 400A and the door frame 800A can act as a single component to secure or capture the glass bowl 700A there between.

In an exemplary embodiment, the corresponding screw points of the inner ring 400A and the washer frame 800A can be conical shaped features that engage one inside the other.

In another exemplary embodiment, the screw points 462A, 464A, 466A, 468A, and 470A can be located around a perimeter of the opening 422A of the inner ring 400A. The screw points 462A, 464A, 466A, 468A, and 470A can be located closer to the opening 422A than to the outside edge of the inner ring 400A. In this manner, these screw points can be located proximate the rim of the glass bowl, thereby transferring and distributing the weight of, and the forces acting on, the glass bowl 700A to the inner ring 400A and the door frame 800A. Additionally, the screw points can be located in a more robust portion of the respective inner ring 400A and door frame 800A than the screw points for the front ring 200.

As explained above, the disclosed exemplary embodiments have a plurality of screw points (e.g., 462A, 464A, 466A, 468A, and 470A). However, in other exemplary embodiments, these screw points can be other types of connection points, attachments, or receptacles for receiving fasteners such as screws, bolts, plastic fasters, or the like, or for mating with other fasteners.

The hinge pockets 427A are configured to receiving a hinge 500, which will be described in more detail below. In an exemplary embodiment of the washer door 10, the hinge 500 can be secured between the inner ring 400A and the washer frame 800A.

With reference to FIGS. 8A-8E, exemplary embodiments of an inner ring 400B, for example for a dryer 30, will now be described.

As shown in FIGS. 8A-8E, an exemplary embodiment of the inner ring 400B can have a substantially circular shape when viewed from the front. However, other shapes are contemplated within the spirit and scope of the invention.

In an exemplary embodiment, the inner ring 400B can be configured to correspond to the front ring 200 and plastic cover or panel 300 of the washer 10 or dryer 30. In an exemplary embodiment, the inner ring 400 can be configured to have features that are particular to a washer door 100.

The inner ring 400B can include an opening 422B that corresponds to the see-through portion 14 of the dryer door 130. The opening 422B can be centered (e.g., concentric) within the inner ring 400B, or off-center. For example, in the exemplary embodiment illustrated, a center of the opening 422B is offset from, or above, a center of the inner ring 400B such that a distance from the opening 422B to the outside edge of the inner ring 400B is greater at the bottom portion of the dryer door 130 than at the top portion of the dryer door 130. The inner ring 400B can be configured to work in conjunction with, or cooperate with, the plastic cover panel 300, which in turn can be configured to work in conjunction with, or cooperate with, the front ring 200.

The opening 422B can have, for example, a substantially circular or oval shape that corresponds to the shape of a glass bowl 700B for the dryer 30. In the illustrated aspect, an upper portion of the opening 422B can have a substantially circular or oval shape and a lower portion of the opening 422B can have a cut-off section or a substantially parallel section that corresponds to the shape of the lower portion of the glass bowl 700B, as shown in FIG. 8C.

Figure 8A:
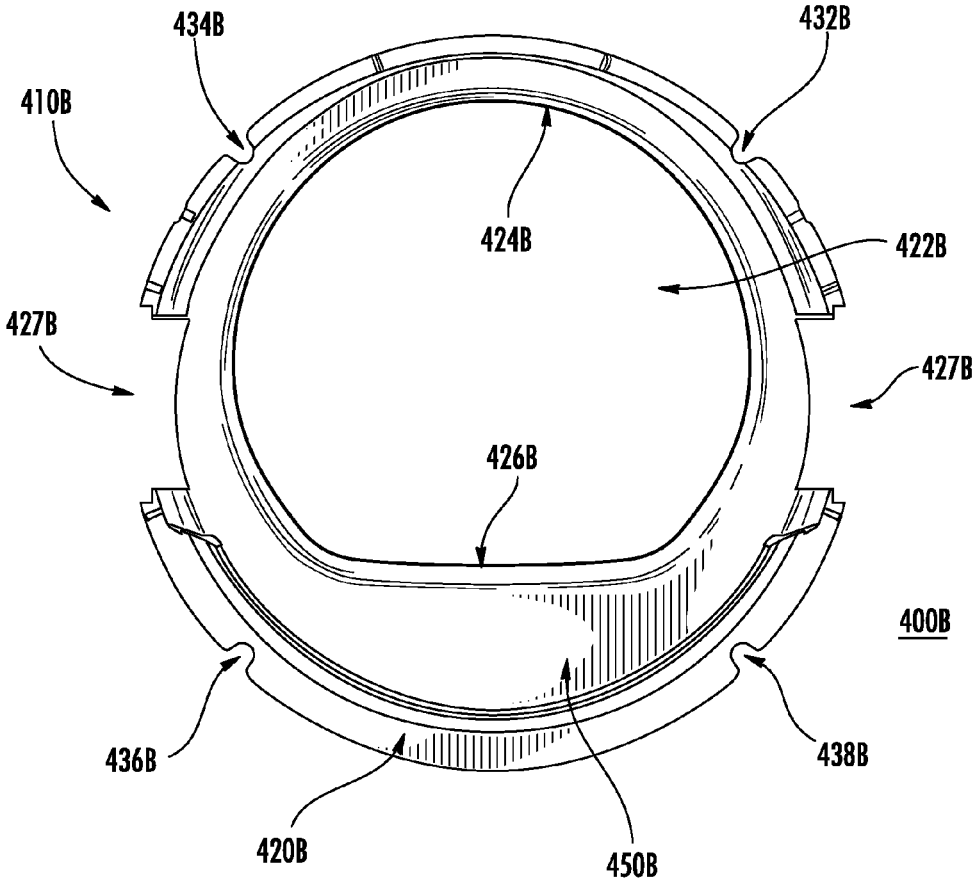
FIG. 8A illustrates a front view of the inner ring of the door of FIGS. 4A, 4B.

FIG. 8A illustrates an exemplary embodiment of the front side 410B of the inner ring 400B. The inner ring 400B can include a ring portion 422B. The ring portion 420B can include a recessed portion or face 450B.

Figure 8B:
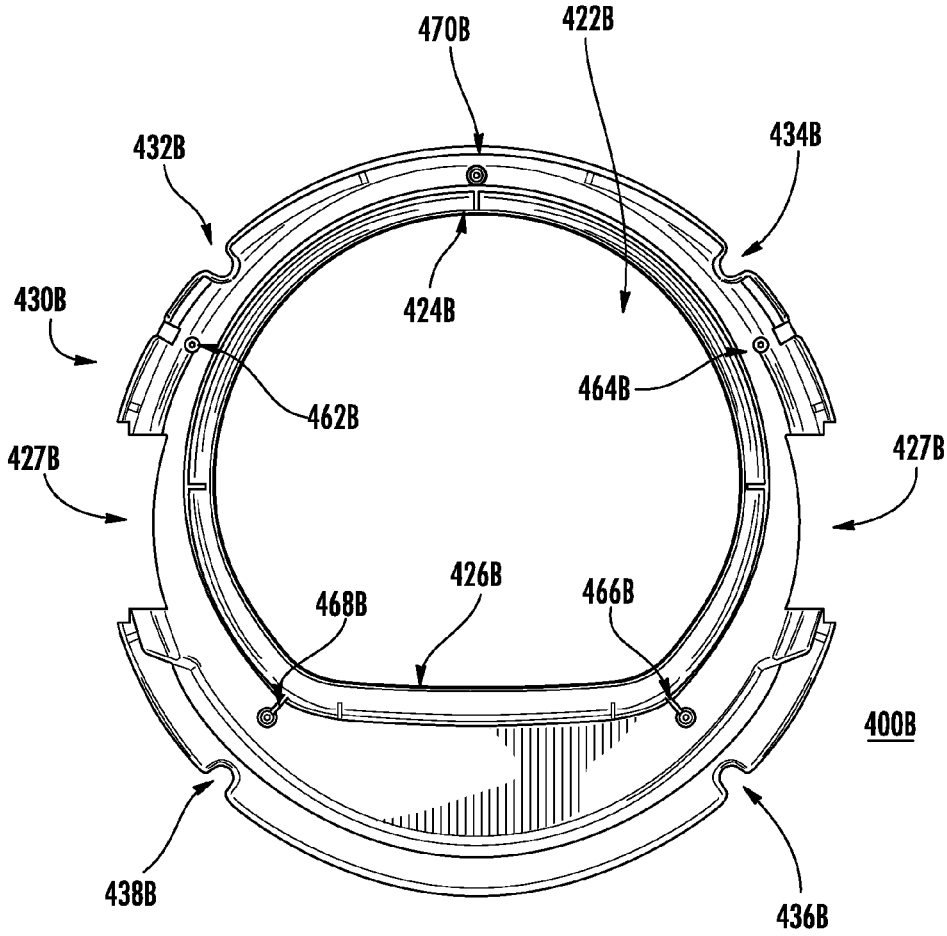
FIG. 8B illustrates a rear view of the inner ring of the door of FIGS. 4A, 4B.
Figure 8C:
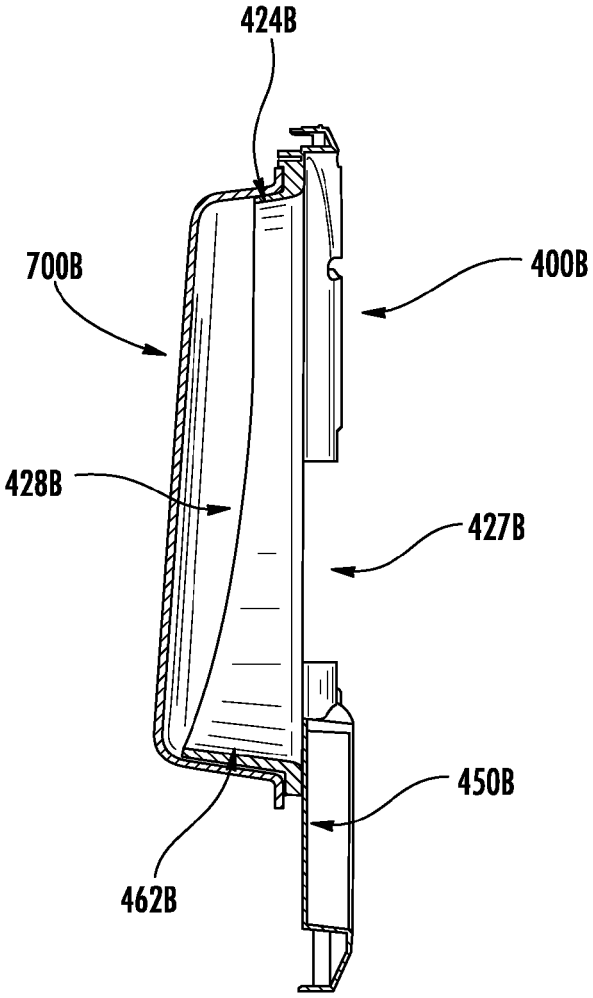
FIG. 8C illustrates a side view of the inner ring of the door of FIGS. 4A, 4B.
Figure 8D:
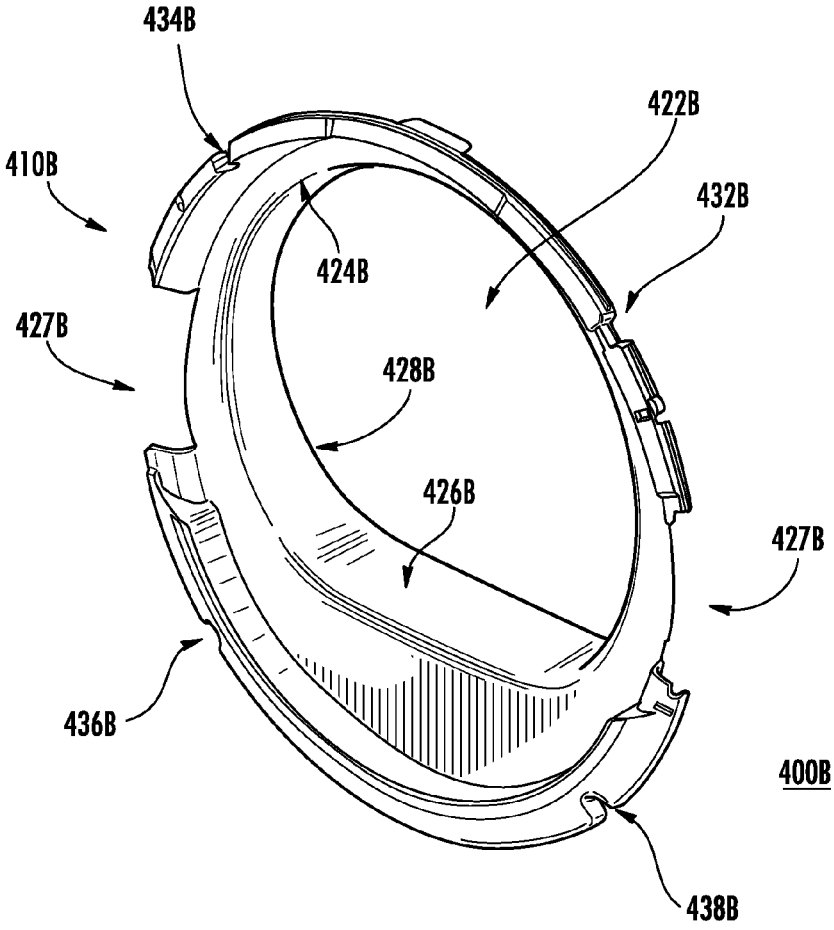
FIG. 8D illustrates a front perspective view of the inner ring of the door of FIGS. 4A, 4B.
Figure 8E:
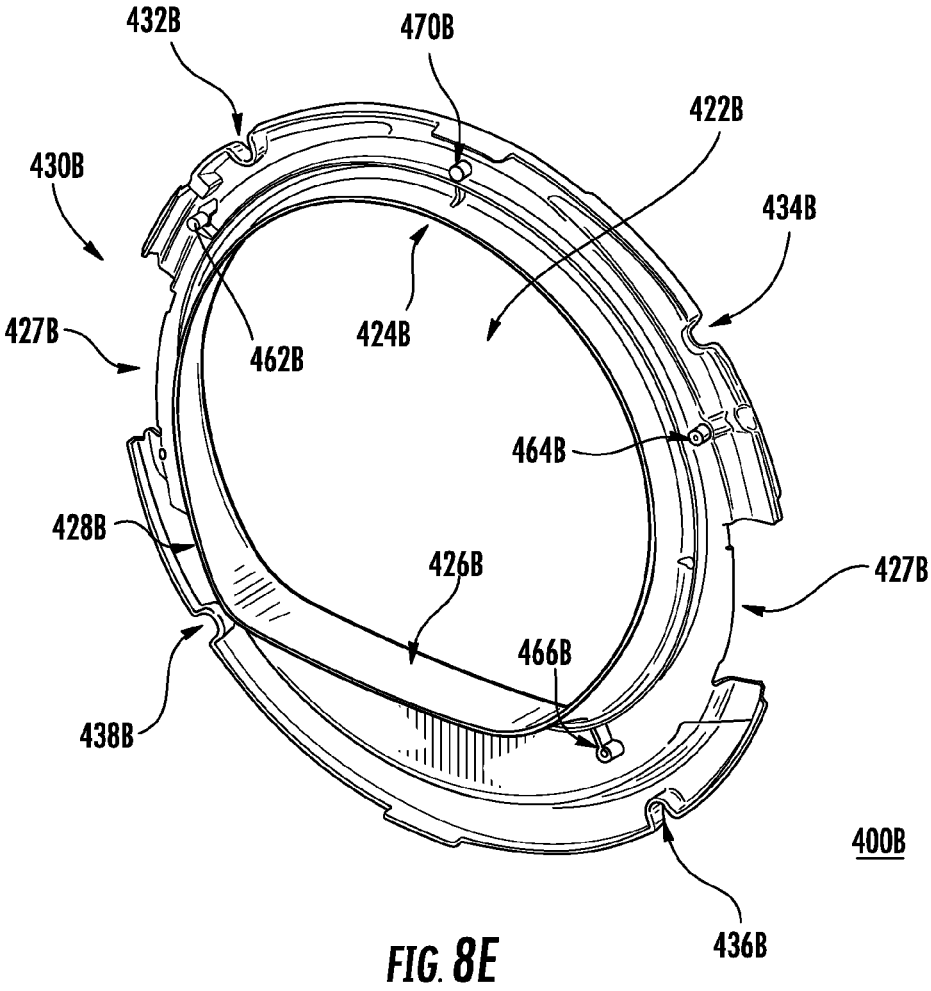
FIG. 8E illustrates a rear perspective view of the inner ring of the door of FIGS. 4A, 4B.

As shown in FIGS. 8A and 8B, the inner ring 400B can include a plurality of locating and/or clearance features 432B, 434B, 436B, and 438B that correspond to the locations of locating and/or clearance features 332, 334, 336, and 338 of the plastic cover panel 300 and the screw points 232, 234, 236, and 238 of the front ring 200. The locating and/or clearance features 432B, 434B, 436B, and 438B can correspond to through holes and/or locating features 832B, 834B, 836B, and 838B of the door frame 800B, as described in more detail below.

The locating and/or clearance features 432B, 434B, 436B, and 438B can include, for example, an opening, notch, clearance feature, locating feature, protrusion, screw boss, partial screw boss, or the like (e.g., 862B, 864B, 866B, 868B) that engages the corresponding feature of the inner ring 400B for aligning and positioning the inner ring 400B in an assembled position. The locating and/or clearance features 432B, 434B, 436B, and 438B can provide clearance for fasteners extending from the door frame 800B such that the fasteners can extend through clearance features 332, 334, 336, and 338 of the plastic cover panel 300 and into the screw points 232, 234, 236, and 238 of the front ring 200.

The locating and/or clearance features 432B, 434B, 436B, 438B, and 440B can be configured such that the inner ring 400B can only have a single orientation for assembly. For example, one or more of the locating and/or clearance features 432B, 434B, 436B, and 438B can have a size different from a size of the other clearance features, such that only a single orientation is possible. In this exemplary embodiment, the size of each clearance feature can correspond to a size of the locating and/or clearance features 332, 334, 336, 338, 340*a*, 340*b*, 342*a*, and 342*b* of the front ring 200 and plastic cover 300. In other exemplary embodiments, the locating and/or clearance features can have a different shape, or a different size and shape, among other things.

In the illustrated exemplary embodiment, the locating and/or clearance features 434B and 438B can be larger than the other clearance features to accommodate both the locating features of the front ring 200 and the locating and/or clearance features 334 and 338 of the plastic cover 300, which can include an extension. The embodiments are not limited to the illustrated exemplary embodiment and other configurations are possible within the spirit and scope of the invention.

In an exemplary embodiment, the inner ring 400B can include clearance features 427B that correspond to the location of the door hinge 500 and door striker 600B of the dryer door 30. The clearance features 440B can be provided on opposite sides of the inner ring 400B to facilitate changing of the door swing from a right-hand swing door to a left-hand swing door by the user.

The dryer door 30 may be configured to be disassembled by the end user. Hence, the inner ring 400B and the door frame 800B can be configured to have the hinges 500 mounted on either side of the door, such that the dryer door 30 can be configured to swing in a right-hand or left-hand direction. As explained below, the hinge pockets 827B for receiving the hinge 500 can be formed in both sides of the door frame 800B. The hinge 500 is secured and captured in the door frame 800B by a hinge cover or plate 550B that is secured to the door frame 800B, for example, using a plurality of screws inserted into screw points 880B of the door frame 800B. In this manner, the end user easily can change the dryer door 30, for example, from a right-hand swing door to a left-hand swing door by removing the hinge plate 550B and hinge 500, and installing the hinge 500 and hinge plate 550B in the opposite hinge pocket 827B. The hinge 500 similarly can be removed from the dryer housing and switched to the other side of the opening.

In an exemplary embodiment, the hinge pockets 427B can be 180° hinge pockets formed between the dryer frame 800B and the hinge plate 550B. The corresponding features of the dryer frame 800B and the hinge plate 550B can be conical shaped features that engage one inside the other.

FIG. 8B illustrates the rear side 430B of the inner ring 400B. The inner ring 400B can include a plurality of screw points 462B, 464B, 466B, 468B, and 470B corresponding to the screw points 862B, 864B, 866B, 868B, and 870B of the door frame 800B, which will be described in more detail below.

In this manner, the inner ring 400B and the door frame 800B can act as a single component to secure or capture the glass bowl 700B there between.

In an exemplary embodiment, the corresponding screw points of the inner ring 400A and the dryer frame 800B can be conical shaped features that engage one inside the other.

In an exemplary embodiment, the screw points 462B, 464B, 466B, 468B, and 470B can be located around a perimeter of the opening 422B of the inner ring 400B. The screw points 462B, 464B, 466B, 468B, and 470B can be located closer to the opening 422B than to the outside edge of the inner ring 400B.

The disclosed exemplary embodiments have a plurality of screw points (e.g., 462B, 464B, 466B, 468B, and 470B). However, in other exemplary embodiments, these screw points can be other types of connection points, attachments, or receptacles for receiving fasteners such as screws, bolts, plastic fasters, or the like, or for mating with other fasteners.

As explained above, the shape and size of the opening 422B can correspond to the shape and size of the glass bowl 700B of the dryer 30. The inner ring 400B can include a funnel section that extends in a direction of an axis of the opening 422B and at least partially inside the glass bowl 700B, as shown in FIG. 8C. The funnel section can include an upper portion 424B and a lower portion 426B that substantially correspond to the inner surface of the glass bowl 700B. The upper portion 424B and the lower portion 426B can be sloped or tapered in a direction of the axis of the opening 422B to correspond to the slope of the inner surface of the glass bowl 700B. In this manner, a portion of the weight of, and forces applied to, the glass bowl 700B can be transferred and distributed to the funnel section of the inner ring 400B.

In the illustrated exemplary embodiment, the upper portion 426A can be substantially circular. The lower portion 426B can extend substantially horizontally in a plane parallel to the plane of the dryer door to correspond to the shape of the glass bowl 700B. The shape of the lower portion 426B can provide clearance for a lint filter that is located below the lower portion 426B and the lower portion of the glass bowl 700B when the door is in the closed position. The lower portion 426B of the funnel can extend a predetermined distance into the glass bowl 700B to limit or block the visibility of the lint filter when the door is in the closed position. A rear edge 428B of the funnel can be tapered or curved from the upper portion 424B to the lower portion 426B, as illustrate din FIG. 8C.

Figure 9A:
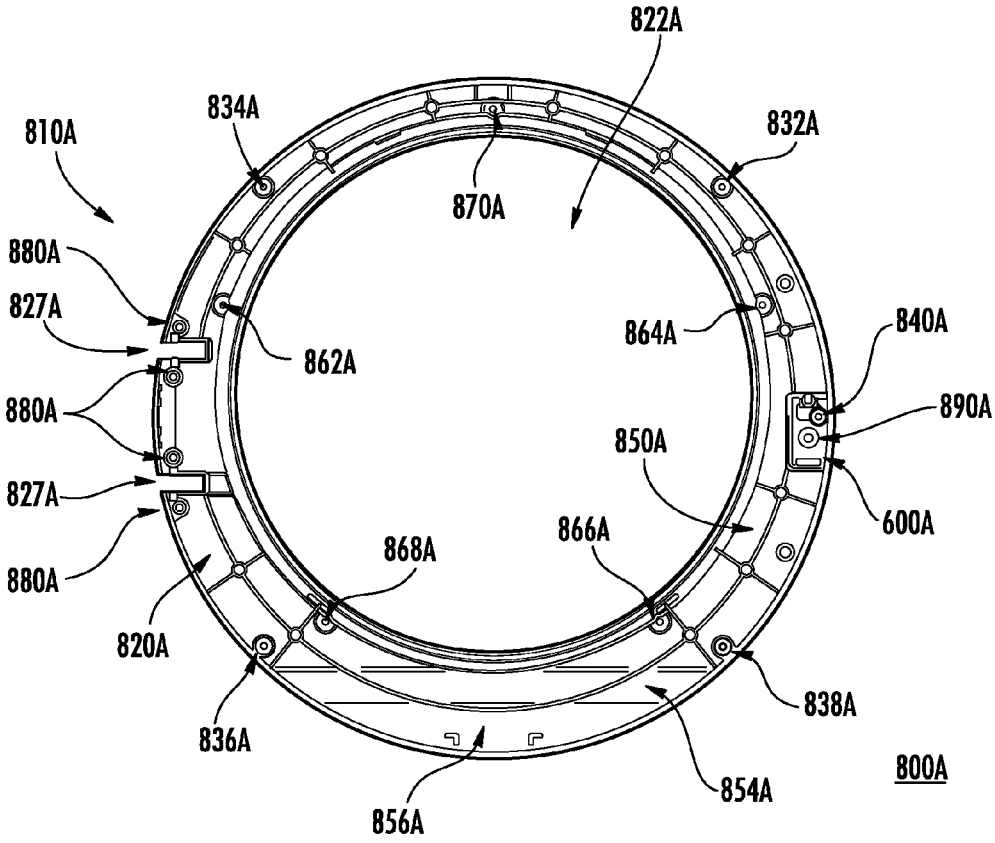
FIG. 9A illustrates a front view of the door frame of the door of FIGS. 3A, 3B.
Figure 9B:
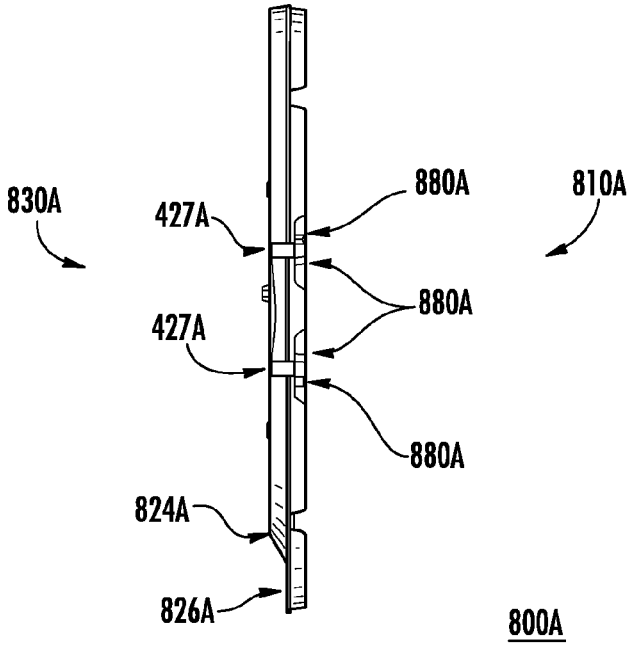
FIG. 9B illustrates a side view of the door frame of the door of FIGS. 3A, 3B.
Figure 9C:
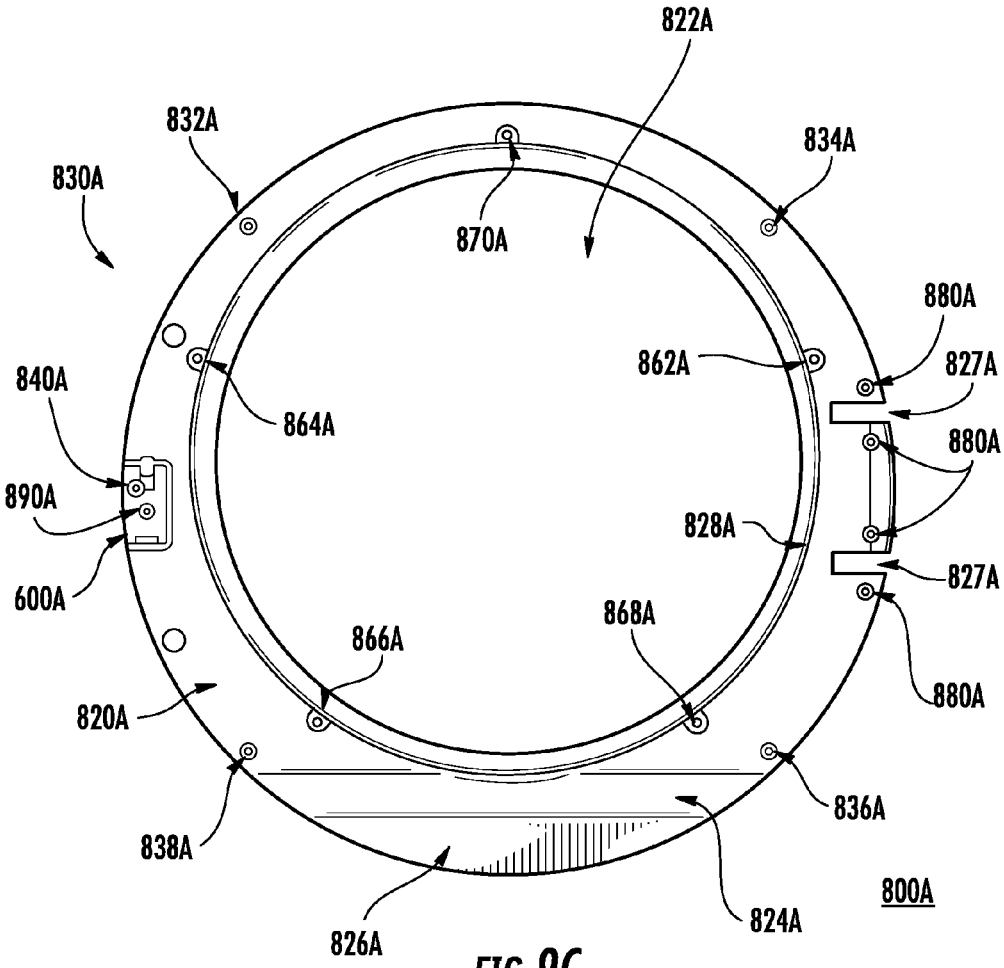
FIG. 9C illustrates a rear view of the door frame of the door of FIGS. 3A, 3B.

With reference to FIGS. 9A-9C, exemplary embodiments of a door frame 800A, for example for a washer 10, will now be described.

As shown in FIGS. 9A-9C, an exemplary embodiment of the door frame 800A can have a substantially circular shape when viewed from the front. However, other shapes are contemplated within the spirit and scope of the invention.

In an exemplary embodiment, the door frame 800A can be configured to have features that are particular to a washer door 100. The door frame 800A can include an opening 822A that corresponds to the see-through portion 14 of the washer door 100. The opening 822A can have, for example, a circular or oval shape, as illustrated. However, in other exemplary embodiments, the opening 822A can have other shapes.

The opening 822A can be centered (e.g., concentric) within the door frame 800A, or off-center. For example, in the exemplary embodiment illustrated, a center of the opening 822A is offset from, or above, a center of the door frame 800A such that a distance from the opening 822A to the outside edge of the door frame 800A is greater at the bottom portion of the washer door 100 than at the top portion of the washer door 100.

FIG. 9A illustrates an exemplary embodiment of the front side 810A of the door frame 800A. FIGS. 9B and 9C illustrate an exemplary embodiment of the rear side 830A of the door frame 800A.

The front side 810A of the door frame 800A can include a ring portion 820A. The rear side 830A of the door frame 800A can include a ring portion 850A.

As shown in FIGS. 9A-9C, the rear side 830A of the door frame 800A can include a tapered or sloped surface 824A leading from the surface of the ring portion 820A to a recessed surface 826A on a lower side of the door frame 800A. The tapered or sloped surface 824A and recessed surface 826A can accommodate the shape of the housing of the washer 10.

The front side 810A of the door frame 800A also can include a corresponding tapered or sloped surface 854A leading from the surface of the ring portion 850A to a recessed surface 856A on a lower side of the door frame 800A.

As shown in FIG. 9A, the front side 810A of the door frame 800A can include a rib pattern to stabilize and strengthen the door frame 800A.

In an exemplary embodiment, the features of the door frame 800A can be configured to correspond to the features of the other components of the washer door, such as the front ring 200 and inner ring 400A. As shown in FIGS. 9A-9C, the door frame 800A can include a plurality of fastener points, such as screw points 832A, 834A, 836A, and 838A, that correspond to the locations of locating and/or clearance features 332, 334, 336, and 338 of the plastic cover panel 300 and the screw points 232, 234, 236, and 238 of the front ring 200.

The screw points 832A, 834A, 836A, and 838A can include, for example, one or more protrusions, screw bosses, partial screw bosses, or through-holes or receptacles for receiving and engaging the corresponding protrusions, screw bosses, partial screw bosses of the plastic cover panel 300 and front ring 200 in an assembled position with the door frame 800A. To assemble these components, fasteners can be inserted through the screw points 832A, 834A, 836A, and 838A of the door frame, through corresponding clearance features 332, 334, 336, and 338 of the plastic cover panel 300 and into the screw points 232, 234, 236, and 238 of the front ring 200, thereby securing the front ring 200 to the door frame 800A. The plastic cover panel 300 is captured or press fit between the front ring 200 and the inner ring 400A, thereby securing the plastic cover panel 300 to the door assembly.

In an exemplary embodiment, the door frame 800A can include one or more screw points 840A that correspond to the location of clearance features 340*a*, 340*b*, 342*a*, or 342*b* of the plastic cover panel 300 and the screw points 240*a*, 240*b* of the front ring 200. These features are configured to correspond to a location of a door handle or grab handle to distribute or transfer the force applied at the handle location to the door frame 800A.

The screw points 832A, 834A, 836A, and 838A can be configured to cooperate with the features of the front ring 200 and plastic cover panel 300 such that these components only can have a single orientation for assembly. For example, one or more of the screw points 832A, 834A, 836A, and 838A can have a size different from a size of the other screw points, such that only a single orientation is possible. In this exemplary embodiment, the size of each screw point can correspond to a size of the screw points 332, 334, 336, 338, 340*a*, 340*b*, 342*a*, and 342*b* of the front ring 200 and plastic cover 300. In other exemplary embodiments, the screw points can have a different shape, or a different size and shape, among other things.

In the illustrated exemplary embodiment, the screw points 834A and 838A can be larger than the other screw points to accommodate both the locating features of the front ring 200 and the locating and/or clearance features 334 and 338 of the plastic cover 300, which can include an extension. The embodiments are not limited to the illustrated exemplary embodiment and other configurations are possible within the spirit and scope of the invention.

With reference again to FIGS. 9A-9C, the door frame 800A can include a plurality of screw points 862A, 864A, 866A, 868A, and 870A that correspond to the locations of fastening points (e.g., screw points) 462A, 464A, 466A, 468A, and 470A of the inner ring 400A.

In an exemplary embodiment, the screw points 862A, 864A, 866A, 868A, and 870A can be located around a perimeter of the opening 822A of the inner ring 400A. The screw points 862A, 864A, 866A, 868A, and 870A can be located closer to the opening 822A than to the outside edge of the door frame 800A. A removable ring 828A can be provided around the perimeter of the opening 822A and can include screw points corresponding to the screw points 862A, 864A, 866A, 868A, and 870A, for example, for strengthening these connections.

The disclosed exemplary embodiments of the door frame 800A have a plurality of screw points 862A, 864A, 866A, 868A, and 870A corresponding to the plurality of screw points 462A, 464A, 466A, 468A, and 470A of the inner ring 400A. However, in other exemplary embodiments, these screw points can be other types of connection points, attachments, or receptacles for receiving fasteners such as screws, bolts, plastic fasters, or the like, or for mating with other fasteners.

As explained above, the door frame 800A can include a first set of screw points 832A, 834A, 836A, and 838A that cooperate with the features of the front ring 200 and plastic cover panel 300, and a second set of screw points 862A, 864A, 866A, 868A, and 870A corresponding to the plurality of screw points 462A, 464A, 466A, 468A, and 470A of the inner ring 400A. In another exemplary embodiment, one of the first set and the second set of screw points can be recessed to reduce or eliminate possible confusion.

The door frame 800A can include hinge pockets 827A for receiving a hinge 500. In an exemplary embodiment of the washer door 10, the hinge 500 can be secured between the inner ring 400A and the washer frame 800A. In this manner, the inner ring 400A and the washer frame 800A act as a single part and the forces on the hinge 500 are transferred over both the inner ring 400A and the washer frame 800A.

The washer door 10 may not be configured to be disassembled by the end user. Hence, the inner ring 400A and the door frame 800A can be configured to have the hinge pockets 427A and 827A on a single side of the door, such that the washer door 10 can be configured to swing in only a single direction.

In an exemplary embodiment, the hinge pockets 827A can be 180° hinge pockets formed between the inner ring 400A and the washer frame 800A. The corresponding features of the inner ring 400A and the washer frame 800A can be conical shaped features that engage one inside the other.

As shown in FIG. 9A, the door frame 800A also can include openings 880A for fastening the door frame 800A to the inner ring 400A at the location of the hinge 500.

The door frame 800A can have an opening 890A for receiving a screw boss and/or locating feature of a door hook 600A. The door frame 800A can include other features, such as one or more slots, recesses, or indentions for receiving corresponding features of the door hook 600A.

With reference to FIG. 9C, the rear side 830A of the door frame 800A will now be described.

The door frame 800A can include a plurality of screw points 862A, 864A, 866A, 868A, and 870A corresponding to the screw points 462A, 464A, 466A, 468A, and 470A of the inner ring 400A, which will be described in more detail below.

In an exemplary embodiment, the screw points 862A, 864A, 866A, 868A, and 870A can be located around a perimeter of the opening 822A of the door frame 800A. The screw points 862A, 864A, 866A, 868A, and 870A can be located closer to the opening 822A than to the outside edge of the door frame 800A.

The disclosed exemplary embodiments have a plurality of screw points (e.g., 862A, 864A, 866A, 868A, and 870A). However, in other exemplary embodiments, these screw points can be other types of connection points, attachments, or receptacles for receiving fasteners such as screws, bolts, plastic fasters, or the like, or for mating with other fasteners.

The hinge pockets 827A are configured to receiving a hinge 500. In an exemplary embodiment of the washer door 10, the hinge 500 can be secured between the inner ring 400A and the washer frame 800A.

As shown in FIGS. 9A-9C, the door frame 800A can include a tapered or sloped surface 824A leading to a recessed surface 826A on a lower side of the door frame 800A. The tapered or sloped surface 824A and recessed surface 826A can accommodate the shape of the housing of the washer 10.

Figure 10A:
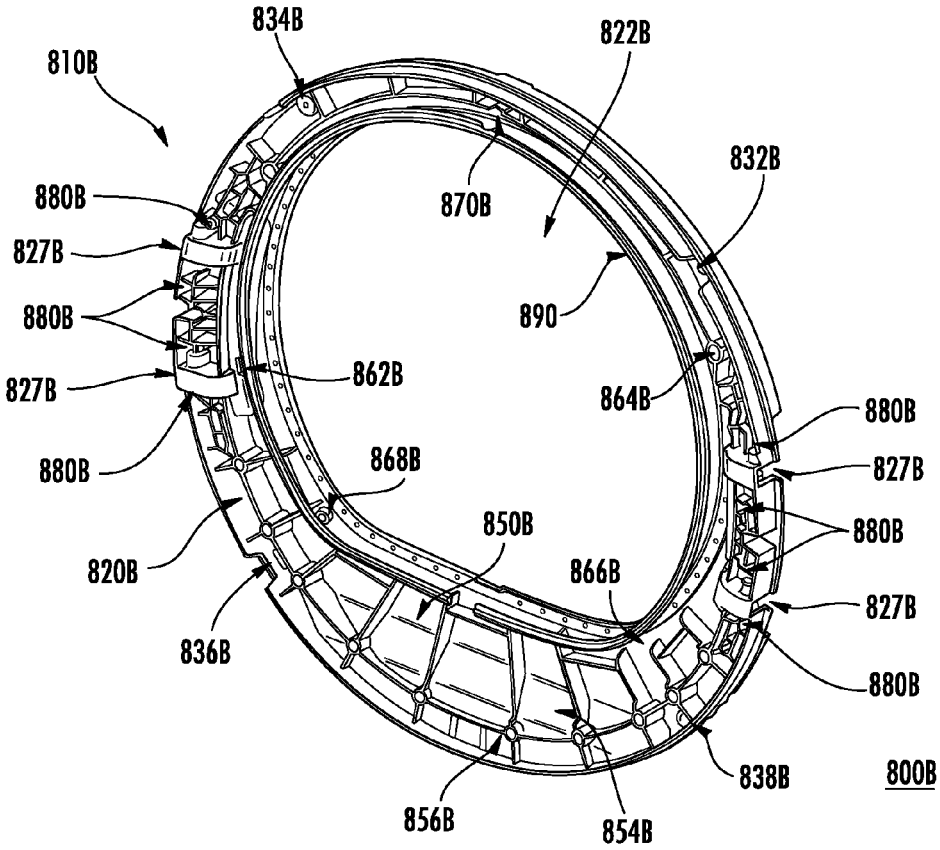
FIG. 10A illustrates a front perspective view of the door frame of the door of FIGS. 4A, 4B.
Figure 10B:
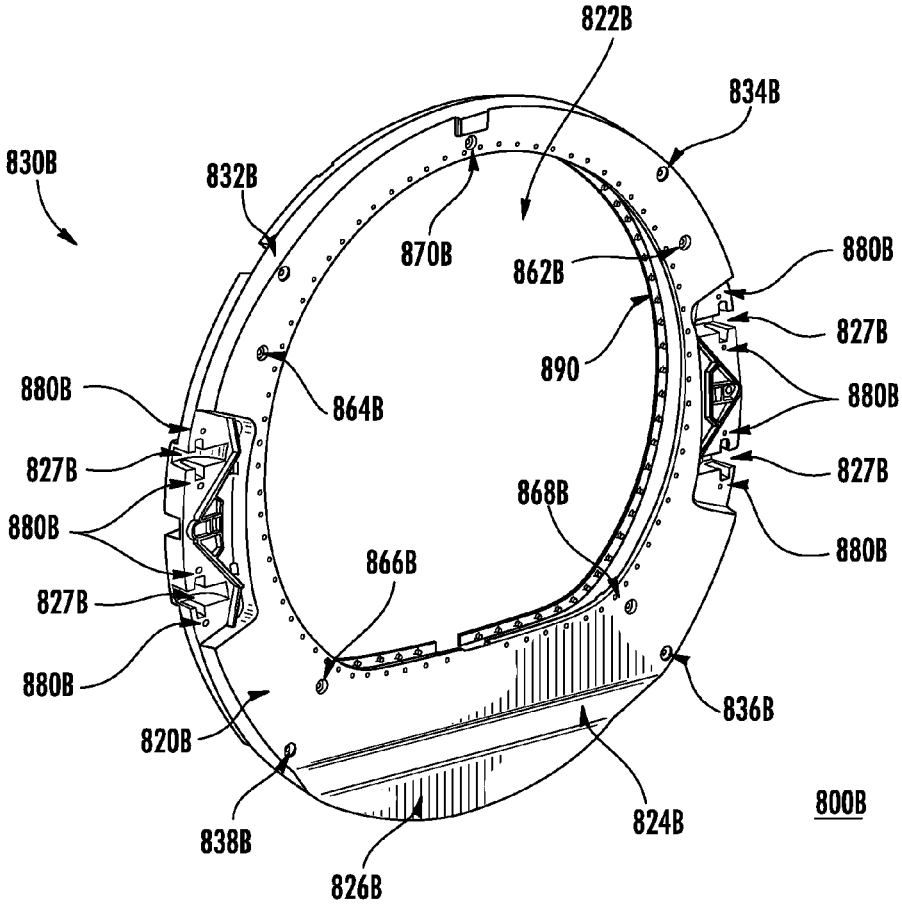
FIG. 10B illustrates a rear perspective view of the door frame of the door of FIGS. 4A, 4B.

With reference to FIGS. 10A and 10B, exemplary embodiments of a door frame 800B, for example for a dryer 30, will now be described.

FIG. 10A illustrates an exemplary embodiment of the front side 810B of the door frame 800B. FIG. 10B illustrates an exemplary embodiment of the rear side 830B of the door frame 800B.

The front side 810B of the door frame 800B can include a ring portion 850B. The rear side 830B of the door frame 800B can include a ring portion 820B.

As shown in FIGS. 10B, the rear side 830B of the door frame 800B can include a tapered or sloped surface 824B leading to a recessed surface 826B on a lower side of the door frame 800B. The tapered or sloped surface 824B and recessed surface 826B can accommodate the shape of the housing of the dryer 30. That is, the portion of the housing of the dryer 30, which is adjacent to the lower side of the dryer door 130 when the door is in the closed position, can include an air flow passage and bearing shield holding the lint filter. This housing shape can be maximized to improve air flow through the lint filter. The tapered or sloped surface 824B and recessed surface 826B of the door frame 800B can accommodate this shape.

As shown in FIG. 10A, the front side 810B of the door frame 800B also can include a corresponding tapered or sloped surface 854B leading from the surface of the ring portion 850B to a recessed surface 856B on a lower side of the door frame 800B.

As shown in FIG. 10A, the front side 810B of the door frame 800B can include a rib pattern to stabilize and strengthen the door frame 800B.

In an exemplary embodiment, the features of the door frame 800B can be configured to correspond to the features of the other components of the washer door, such as the front ring 200 and inner ring 400B. As shown in FIGS. 10A and 10B, the door frame 800B can include a plurality of fastener points, such as screw points 832B, 834B, 836B, and 838B, that correspond to the locations of locating and/or clearance features 332, 334, 336, and 338 of the plastic cover panel 300 and the screw points 232, 234, 236, and 238 of the front ring 200.

The screw points 832B, 834B, 836B, and 838B can include, for example, one or more protrusions, screw bosses, partial screw bosses, or through-holes or receptacles for receiving and engaging the corresponding protrusions, screw bosses, partial screw bosses of the plastic cover panel 300 and front ring 200 in an assembled position with the door frame 800B. To assemble these components, fasteners can be inserted through the screw points 832B, 834B, 836B, and 838B of the door frame, through corresponding clearance features 332, 334, 336, and 338 of the plastic cover panel 300 and into the screw points 232, 234, 236, and 238 of the front ring 200, thereby securing the front ring 200 to the door frame 800. The plastic cover panel 300 is captured or press fit between the front ring 200 and the inner ring 400B, thereby securing the plastic cover panel 300 to the door assembly.

In an exemplary embodiment, the door frame 800B can include one or more screw points 840A that correspond to the location of clearance features 340*a*, 340*b*, 342*a*, or 342*b* of the plastic cover panel 300 and the screw points 240*a*, 240*b* of the front ring 200. These features are configured to correspond to a location of a door handle or grab handle to distribute or transfer the force applied at the handle location to the door frame 800B.

The screw points 832B, 834B, 836B, and 838B can be configured to cooperate with the features of the front ring 200 and plastic cover panel 300 such that these components only can have a single orientation for assembly. For example, one or more of the screw points 832B, 834B, 836B, and 838B can have a size different from a size of the other screw points, such that only a single orientation is possible. In this exemplary embodiment, the size of each screw point can correspond to a size of the screw points 332, 334, 336, 338, 340*a*, 340*b*, 342*a*, and 342*b* of the front ring 200 and plastic cover 300. In other exemplary embodiments, the screw points can have a different shape, or a different size and shape, among other things.

In the illustrated exemplary embodiment, the screw points 834B and 838B can be larger than the other screw points to accommodate both the locating features of the front ring 200 and the locating and/or clearance features 334 and 338 of the plastic cover 300, which can include an extension. The embodiments are not limited to the illustrated exemplary embodiment and other configurations are possible within the spirit and scope of the invention.

With reference again to FIGS. 10A and 10B, the door frame 800B can include a plurality of screw points 862B, 864B, 866B, 868B, and 870B that correspond to the locations of fastening points (e.g., screw points) 462B, 464B, 466B, 468B, and 470B of the inner ring 400B.

In an exemplary embodiment, the screw points 862B, 864B, 866B, 868B, and 870B can be located around a perimeter of the opening 822B of the inner ring 400B. The screw points 862B, 864B, 866B, 868B, and 870B can be located closer to the opening 822B than to the outside edge of the door frame 800B.

The disclosed exemplary embodiments of the door frame 800B have a plurality of screw points 862B, 864B, 866B, 868B, and 870B corresponding to the plurality of screw points 462B, 464B, 466B, 468B, and 470B of the inner ring 400B. However, in other exemplary embodiments, these screw points can be other types of connection points, attachments, or receptacles for receiving fasteners such as screws, bolts, plastic fasters, or the like, or for mating with other fasteners.

As explained above, the door frame 800B can include a first set of screw points 832B, 834B, 836B, and 838B that cooperate with the features of the front ring 200 and plastic cover panel 300, and a second set of screw points 862B, 864B, 866B, 868B, and 870B corresponding to the plurality of screw points 462B, 464B, 466B, 468B, and 470B of the inner ring 400B. In another exemplary embodiment, one of the first set and the second set of screw points can be recessed to reduce or eliminate possible confusion.

The dryer door 30 may be configured to be disassembled by the end user. Hence, the inner ring 400B and the door frame 800B can be configured to have the hinges 500 mounted on either side of the door, such that the dryer door 30 can be configured to swing in a right-hand or left-hand direction. As explained below, the hinge pockets 827B for receiving the hinge 500 can be formed in both sides of the door frame 800B. The hinge 500 is secured and captured in the door frame 800B by a hinge cover or plate 550B that is secured to the door frame 800B, for example, using a plurality of screws inserted into screw points 880B of the door frame 800B. In this manner, the end user easily can change the dryer door 30, for example, from a right-hand swing door to a left-hand swing door by removing the hinge plate 550B and hinge 500, and installing the hinge 500 and hinge plate 550B in the opposite hinge pocket 827B. The hinge 500 similarly can be removed from the dryer housing and switched to the other side of the opening.

In an exemplary embodiment, the hinge pockets 427B can be 180° hinge pockets formed between the dryer frame 800B and the hinge plate 550B. The corresponding features of the dryer frame 800B and the hinge plate 550B can be conical shaped features that engage one inside the other.

The dryer door 30 may be configured to be disassembled by the end user. Hence, the inner ring 400B and the door frame 800B can be configured to have the hinges 500 mounted on either side of the door, such that the dryer door 30 can be configured to swing in a right-hand or left-hand direction. As explained below, the hinge pockets 827B for receiving the hinge 500 can be formed in both sides of the door frame 800B. The hinge 500 is secured and captured in the door frame 800B by a hinge cover or plate 550B that is secured to the door frame 800B, for example, using a plurality of screws inserted into screw points 880B of the door frame 800B. In this manner, the end user easily can change the dryer door 30, for example, from a right-hand swing door to a left-hand swing door by removing the hinge plate 550B and hinge 500, and installing the hinge 500 and hinge plate 550B in the opposite hinge pocket 827B. The hinge 500 similarly can be removed from the dryer housing and switched to the other side of the opening.

In an exemplary embodiment, the hinge pockets 427B can be 180° hinge pockets formed between the dryer frame 800B and the hinge plate 550B. The corresponding features of the dryer frame 800B and the hinge plate 550B can be conical shaped features that engage one inside the other.

FIG. 10B illustrates the rear side 830B of the door frame 800B. The door frame 800B can include a plurality of screw points 862B, 864B, 866B, 868B, and 870B corresponding to the screw points 462B, 464B, 466B, 468B, and 470B of the inner ring 400B.

In this manner, the inner ring 400B and the door frame 800B can act as a single component to secure or capture the glass bowl 700B there between.

In an exemplary embodiment, the corresponding screw points of the inner ring 400B and the dryer frame 800B can be conical shaped features that engage one inside the other.

As shown in FIG. 10A, the door frame 800B also can include openings 880B for fastening the door frame 800B to the inner ring 400B at the location of the hinge 500.

The door frame 800B can have an opening 890B for receiving a screw boss and/or locating feature of a door striker 600B. The door frame 800B can include other features, such as one or more slots, recesses, or indentions for receiving corresponding features of the door striker 600B.

With reference to FIG. 10B, the rear side 830B of the door frame 800B will now be described.

The door frame 800B can include a plurality of screw points 862B, 864B, 866B, 868B, and 870B corresponding to the screw points 462B, 464B, 466B, 468B, and 470B of the inner ring 400B.

In an exemplary embodiment, the screw points 862B, 864B, 866B, 868B, and 870B can be located around a perimeter of the opening 422B of the inner ring 400B. The screw points 862B, 864B, 866B, 868B, and 870B can be located closer to the opening 422B than to the outside edge of the inner ring 400B.

The disclosed exemplary embodiments have a plurality of screw points (e.g., 862B, 864B, 866B, 868B, and 870B). However, in other exemplary embodiments, these screw points can be other types of connection points, attachments, or receptacles for receiving fasteners such as screws, bolts, plastic fasters, or the like, or for mating with other fasteners.

The hinge pockets 827B are configured to receiving a hinge 500. In an exemplary embodiment of the washer door 10, the hinge 500 can be secured between the inner ring 400B and the washer frame 800B.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

What is claimed is:

1. A household appliance comprising:

a housing having an opening for accessing an interior of the housing;

a tub disposed inside the housing, the tub having a rotating drum therein for receiving laundry through the opening; and a door assembly having a see-through portion for viewing into the tub, the door assembly being pivotably coupled to the housing and movable between an open position for accessing the opening of the housing and a closed position for closing the opening of the housing, wherein the door assembly includes:

a door frame; and a front ring coupled directly or indirectly to the door frame, wherein the front ring includes:

a front face having an outside edge and an inside edge, wherein the inside edge defines an opening in the front face that substantially corresponds to the see-through portion of the door; and a recessed rear face on an opposite side of the front ring from the front face, wherein the recessed rear face includes a handle portion extending around at least a portion of the front ring.

2. The household appliance of claim 1, wherein the household appliance is a washer.

3. The household appliance of claim 1, wherein the household appliance is a dryer.

4. The household appliance of claim 1, wherein the household appliance is one of a washer and a dryer, and wherein the front ring is universal to the door of the washer and the dryer.

5. The household appliance of claim 1, wherein the handle portion extends around at least a 90° portion of the front ring.

6. The household appliance of claim 1, wherein the handle portion extends around at least a 180° portion of the front ring.

7. The household appliance of claim 1, wherein the handle portion includes a grip portion.

8. The household appliance of claim 7, wherein the grip portion includes a gripping element.

9. The household appliance of claim 7, wherein the grip portion extends around at least a portion of the rear face.

10. The household appliance of claim 9, wherein the grip portion extends continuously around the portion of the rear face.

11. The household appliance of claim 9, wherein the grip portion extends intermittently around the portion of the rear face.

12. The household appliance of claim 1, wherein the front ring is configured for a right-hand door assembly in a first position with respect to an axis of the opening of the front ring, and a left-hand door assembly in a second position with respect to the axis of the opening of the front ring, wherein an angle of the first position is 180° about the axis from an angle of the second position.

13. The household appliance of claim 1, wherein the front ring includes a plurality of fastening points spaced around a perimeter of the front ring.

14. The household appliance of claim 13, wherein the plurality of fastening points of the front ring corresponds to a plurality of fastening points of the door frame.

15. The household appliance of claim 13, wherein four of the plurality of fastening points of the front ring are arranged symmetrically around the front ring, and wherein a fifth of the plurality of fastening points is arranged between two adjacent fastening points of the four of the plurality of fastening points.

16. The household appliance of claim 15, wherein the handle portion is arranged symmetrically with respect to the fifth of the plurality of fastening points.

17. The household appliance of claim 15, wherein the handle portion includes a primary door handle located on the front ring at an angle of 90° about the axis of the opening from a lowermost portion of the front ring, and wherein the fifth of the plurality of fastening points is located one of at and adjacent to the primary door handle for transferring force applied at the primary door handle to the door frame.

18. The household appliance of claim 17, wherein the front surface of the front ring includes one of a recessed edge and a tapered edge corresponding to a location of the primary door handle.

19. The household appliance of claim 13, wherein the plurality of fastening points are configured such that the front ring can only have a single orientation for a left-hand door assembly and only a single orientation for a right-hand door assembly.

20. The household appliance of claim 1, wherein the outside edge of the front ring has a substantially circular shape.

21. The household appliance of claim 1, wherein the inside edge of the front ring has a substantially circular shape.

22. The household appliance of claim 1, wherein a center point of the opening is offset from and above a center point of the front ring.

23. The household appliance of claim 1, wherein a first distance from the inside edge to the outside edge at a bottom portion of the front ring is greater than a second distance from the inside edge to the outside edge at a top portion of the door.

24. The household appliance of claim 1, wherein the front ring includes a side surface extending from the edge of the front face in a direction of an axis of the opening, and wherein the side surface of the front ring includes a hinge clearance feature that provides clearance for a hinge coupling the door assembly to the housing.

25. The household appliance of claim 1, wherein the door assembly further includes:

an inner ring coupled to the door frame;

a glass bowl secured between the inner ring and the door frame; and a cover panel secured between the front ring and the inner ring.

26. The household appliance of claim 25, wherein the front ring is configured to work in conjunction with the cover panel, and wherein the cover panel is configured to work in conjunction with the inner ring.

27. The household appliance of claim 25, wherein a plurality of fasteners secures the front ring to the door frame, wherein each of the plurality of fasteners extends through an opening in the door frame, one of an opening and a clearance feature of the inner ring, one of an opening and a clearance feature of the inner ring, and into one of the plurality of fastening points of the front ring.

28. The household appliance of claim 25, wherein the inner ring is secured separately to the door frame from the front ring.

29. The household appliance of claim 25, wherein the door assembly further includes:

a hinge pivotably coupling the door frame to the housing of the household appliance; and a door hook for securing the door frame to the housing of the household appliance in the closed position.

30. A front ring for a door assembly of a household appliance, wherein the household appliance includes a housing having an opening for accessing an interior of the housing, a tub disposed inside the housing, the tub having a rotating drum therein for receiving laundry through the opening, and a door assembly having a see-through portion for viewing into the tub, the door assembly being pivotably coupled to the housing and movable between an open position for accessing the opening of the housing and a closed position for closing the opening of the housing, wherein the front ring comprises:

a front face having an outside edge and an inside edge, wherein the inside edge defines an opening in the front face that corresponds to the see-through portion of the door;

a recessed rear face on an opposite side of the front ring from the front face, wherein the recessed rear face includes a handle portion extending around at least a portion of the front ring.

* * * * *